US007513959B2

(12) United States Patent
Takashima et al.

(10) Patent No.: US 7,513,959 B2
(45) Date of Patent: Apr. 7, 2009

(54) NON-ORIENTED ELECTRICAL STEEL SHEET AND METHOD FOR MANUFACTURING THE SAME

(75) Inventors: Minoru Takashima, Tokyo (JP); Masaaki Kohno, Tokyo (JP); Katsumi Yamada, Tokyo (JP); Masaki Kawano, Tokyo (JP); Kaoru Sato, Tokyo (JP)

(73) Assignee: JFE Steel Corporation (JP)

( * ) Notice: Subject to any disclaimer, the term of this patent is extended or adjusted under 35 U.S.C. 154(b) by 422 days.

(21) Appl. No.: 10/537,194

(22) PCT Filed: Dec. 3, 2003

(86) PCT No.: PCT/JP03/15462

§ 371 (c)(1),
(2), (4) Date: Jun. 22, 2005

(87) PCT Pub. No.: WO2004/050934

PCT Pub. Date: Jun. 17, 2004

(65) Prior Publication Data

US 2006/0124207 A1 Jun. 15, 2006

(30) Foreign Application Priority Data

Dec. 5, 2002 (JP) ..... 2002-353250
Mar. 31, 2003 (JP) ..... 2003-095737
Mar. 31, 2003 (JP) ..... 2003-095881

(51) Int. Cl.
*H01F 1/147* (2006.01)

(52) U.S. Cl. ..... 148/307; 148/306; 148/111; 148/120

(58) Field of Classification Search ..... None
See application file for complete search history.

(56) References Cited

U.S. PATENT DOCUMENTS 5,037,493 A * 8/1991 Tomita et al. ..... 148/111
5,062,905 A * 11/1991 Tomita et al. ..... 148/111

FOREIGN PATENT DOCUMENTS

EP 1 081 238 A 3/2001
JP 49-83613 8/1974
JP 60-238421 11/1985

(Continued)

OTHER PUBLICATIONS

Gerhard Salje et al., "Das Kupfer-Eisen Zustandsdiagramm im Bereich von 650 bis 1050° C.", Z. Metallkde, Bd. 69(1978) H. 3, pp. 167-169.

*Primary Examiner*—Joh P. Sheehan
(74) *Attorney, Agent, or Firm*—DLA Piper LLP (US)

(57) ABSTRACT

When a non-oriented electrical steel sheet is manufactured, simultaneously having superior magnetic properties and high strengths, a composition containing 0.02% or less of C, 4.5% or less of Si, 5.0% or less (including 0) of Ni, and 0.2% to 4.0% of Cu is used, and a solute Cu is allowed to appropriately remain in finish annealing. In the steel sheet thus obtained, finely shaped Cu is precipitated by aging treatment, and while the magnetic properties are not degraded, the yield stress is increased to not less than CYS (MPa) represented by the following formula:

note $$CYS=180+5{,}600[\%\ C]+95[\%\ Si]+50[\%\ Mn]+37[\%\ Al]+435[\%\ P]+25[\%\ Ni]+22d^{-1/2}$$

where d is an average grain diameter (mm) of crystal grains.

12 Claims, 2 Drawing Sheets

FOREIGN PATENT DOCUMENTS

| | | | |
|---|---|---|---|
| JP | 62-89816 | | 4/1987 |
| JP | 62-256917 | | 11/1987 |
| JP | 02-073919 | | 3/1990 |
| JP | 4-56109 | | 9/1992 |
| JP | 6-10047 | | 1/1994 |
| JP | 06-330255 | | 11/1994 |
| JP | 08 225854 | A | 9/1996 |
| JP | 08-295936 | | 11/1996 |
| JP | 09-67654 | | 3/1997 |
| JP | 09 209039 | A | 8/1997 |
| JP | 09-241793 | | 9/1997 |
| JP | 09 316619 | A | 12/1997 |
| JP | 10 306344 | A | 11/1998 |
| JP | 2000 282151 | A | 10/2000 |
| JP | 2001-172752 | | 6/2001 |
| JP | 2001 172752 | A | 6/2001 |
| JP | 2004-315956 | | 11/2004 |
| WO | WO 2007/074987 | A1 * | 5/2007 |

* cited by examiner

NON-ORIENTED ELECTRICAL STEEL SHEET AND METHOD FOR MANUFACTURING THE SAME

TECHNICAL FIELD

The present invention relates to non-oriented electrical steel sheets, and more particularly, relates to a non-oriented electrical steel sheet having high strengths and a low iron loss and a method for manufacturing the same, the steel sheet being suitably used for a component receiving a large stress which is typically represented by a rotor for use in a high speed motor.

The non-oriented electrical steel sheet manufactured in accordance with the present invention has a feature in which the yield strength and the like are increased by aging treatment so that strengths of a rotor assembled therefrom are increased. In addition, the non-oriented electrical steel sheet also has a feature in which since the yield strength is low before aging treatment, punching processing can be easily performed.

BACKGROUND ART

In recent years, due to advancement of drive circuit systems of motors, it has become possible to perform frequency-control of drive power supply, and as a result, a high speed motor driven by adjustable speed control or driven at a higher frequency than a power frequency has been increasingly in demand. In the high speed motors driven as described above, it is necessary to use rotors having strengths capable of withstanding high speed rotation.

That is, a centrifugal force applied to a rotor is proportional to the rotating-radius and is increased in proportional to the square of a rotational speed. Hence, in medium-sized and large-sized high speed motors, a stress more than 600 MPa may be applied to rotors thereof in some cases. Accordingly, for the high speed motors as described above, increase in strengths of the rotor must be achieved.

In addition, in view of recent improvement in motor efficiency, a magnet-embedded type (IPM: Interior Permanent Magnet) DC inverter control motor, in which permanent magnets are embedded in a rotor, has also been increasingly in demand. In the motor described above, magnets embedded in the rotor are liable to jump out therefrom, and in order to prevent the magnets from jumping out, a large force is applied to an electrical steel sheet used for the rotor. From this point of view, an electrical steel sheet for use in the motor, in particular, for use in the rotor has been required to have high strengths.

Since rotating devices such as motors and generators exploit electromagnetic phenomena, core materials therefor are required to have magnetic properties. In particular, the core materials preferably have a low iron loss and a high magnetic flux density.

In general, for assembling an iron core of a rotor, non-oriented electrical steel sheets are formed by punching using a press machine and are then laminated to each other for the use. However, when a core material of rotors used for high speed motors cannot satisfy the mechanical strengths described above, instead of that, a rotor made of cast steel having higher strengths must be used. However, since the cast steel-made rotor mentioned above is a bulk product, compared to a rotor formed of electrical steel sheets laminated to each other, a ripple loss affecting the rotor is large, thereby primarily causing decrease in motor efficiency. The ripple loss indicates an eddy current loss caused by a high frequency magnetic flux.

Accordingly, an electrical steel sheet having superior magnetic properties and high strengths has been desired as a core material for rotors.

As a strengthening method from a metallurgical point of view, for example, solid solution strengthening, precipitation strengthening, and grain-refining strengthening have been known, and there are examples in which some methods mentioned above were applied to electrical steel sheets. For example, according to Japanese Unexamined Patent Application Publication No. 60-238421, based on the results of investigation on advantages and disadvantages of the each strengthening method mentioned above, as a method having the least influence on magnetic properties, the use of solid solution strengthening has been proposed. In addition, a method has been disclosed in which, besides increase of the content of Si to 3.5% to 7.0% (mass percent, hereinafter, the same as above), an element having high capability of solid solution strengthening is added.

In addition, in Japanese Unexamined Patent Application Publication No. 62-256917, a method for controlling the diameter of recrystallized grains has been disclosed in which the content of Si is set in the range of from 2.0% to 3.5%, the content of Ni or the contents of Ni and Mo are increased, and low-temperature annealing at a temperature of 650 to 850° C. is performed. Furthermore, as a method using precipitation strengthening, in Japanese Unexamined Patent Application Publication No. 6-330255, a method has been disclosed in which the content of Si is set in the range of from 2.0% to 4.0% and fine carbides and nitrides of Nb, Zr, Ti, and/or V are precipitated.

By the methods described above, electrical steel sheets can be obtained having a high strength to a certain extent. However, when steel is used in which the contents of Si and an element for solid solution strengthening are high, as disclosed in Japanese Unexamined Patent Application Publication No. 60-238421, cold rolling properties are extremely degraded, and as a result, it becomes disadvantageously difficult to perform stable industrial manufacturing. Furthermore, a problem may arise in that magnetic flux density $B_{50}$ of the steel sheet obtained by this technique is also seriously decreased to 1.56 to 1.60 T.

In the method disclosed in Japanese Unexamined Patent Application Publication No. 62-256917, in order to increase the mechanical strengths, the growth of recrystallized grains must be suppressed by low-temperature annealing, and as a result, in a relatively low frequency range, for example, of from a power frequency (approximately 50 Hz) to several hundred Hertz, a problem occurs in that the iron loss is decreased.

Accordingly, the electrical steel sheet obtained by the method disclosed in Japanese Unexamined Patent Application Publication No. 62-256917 cannot be used as a material for a stator member since the iron loss of this application is important in this frequency range. Hence, an extreme decrease in yield of the electrical steel sheet according to this method could not been avoided. That is, when stator and rotor members are obtained by punching, a ring-shaped stator member is generally punched out from one steel sheet, and from a remaining central part of the same steel sheet, a rotor member is also obtained by punching, thereby reducing waste. However, in the method disclosed in Japanese Unexamined Patent Application Publication No. 62-256917, two types of members must be obtained from different steel sheets by punching, and as a result, the yield is unfavorably decreased.

On the other hand, according to the method disclosed in Japanese Unexamined Patent Application Publication No. 6-330255, since the carbides and nitrides themselves function as a barrier to magnetic wall movement and interfere with the growth of crystal grains of an electrical steel sheet, the degradation in iron loss is still disadvantageously large.

In addition, regardless of whether any of the methods described above is used, the electrical steel sheets manufactured thereby each have a high hardness, and as a result, the punchabilities thereof are inferior. That is, when the steel sheet for laminated core is punched out, die wear becomes very large, and hence large burrs are liable to be generated in an early stage.

As will be described later, as one of the features of the present invention, the composition of a steel sheet according to the present invention contains a predetermined amount of Cu. Hence, apart from the problems described above, the current status of Cu used in non-oriented electrical steel sheets will be described.

As an example in which Cu is added to an electrical steel sheet, a technique for improving punchabilities has been disclosed in Japanese Unexamined Patent Application Publication No. 62-89816 in which 0.1 to 1.0% of C is added to a steel sheet so as to precipitate graphite. As a method of recrystallization annealing (finish annealing), box annealing is recommended. In this technique, as an element facilitating the precipitation of graphite, Cu in an amount of 1.0% or less is recommended to be added; however, disadvantage in cost is also implied.

However, the electrical steel sheet described above having a composition containing 0.1% or more of C is an exceptional one, and in a general electrical steel sheet, the addition of Cu is not recommended in view of the magnetic properties and the like. For example, in Japanese Unexamined Patent Application Publication No. 9-67654, a non-oriented electrical steel sheet containing more than 1% to 3.5% of Si or the like has been disclosed; however, since the precipitation of CuS and the like has adverse influences on the magnetic properties, the content of Cu is limited to 0.05% or less.

In addition, as a technique which contain a larger amount of Cu than that described above, a method has been disclosed in Japanese Unexamined Patent Application Publication No. 8-295936 in which a non-oriented electrical steel sheet is manufactured from raw materials including scrap steel. In this technique, in order to reduce adverse influences on the magnetic properties caused by alloying elements (0.015% to 0.2% of Cu: 0.01% to 0.5% of Ni: 0.02% to 0.2% of Cr: 0.003% to 0.2% of Sn: and the like) contained in scrap, for example, measures are proposed in which the contents of V and Nb are limited, and in which the diameter of crystal grains after hot-rolled sheet annealing is controlled to 50 μm or less. However, also for this technique, the above elements such as Cu are naturally disadvantageous, and a primary object of this technique is only to reduce the adverse influences of the above elements. In addition, the contents of Cu and the like thus disclosed are small.

Furthermore, as steel which does not contain Si, high-strength steel used for electric machinery has been disclosed in Japanese Unexamined Patent Application Publication No. 49-83613, the steel being composed of 1% to 5% of Cu, 1% to 5% of Ni, and iron as the balance. According to this technique, after solution treatment-quenching and cold rolling are repeatedly performed for steel having the above composition, aging treatment is performed, and then steel having a high strength and a low iron loss can be obtained. However, degradation in iron loss caused by aging treatment has not been satisfactorily suppressed.

DISCLOSURE OF INVENTION

[Problems to be Solved by the Invention]

As described above, in order to stably perform industrial manufacturing of an electrical steel sheet which simultaneously has high strengths and a low iron loss, the conventional methods have not been satisfactory.

In addition, an object of sufficiently increasing rotor strengths while superior punchabilities and a preferable iron loss are maintained has not been accomplished by the above conventional methods. In particular, it has been believed that since the punchabilities degrade as the yield strength is improved, superior punchabilities and high yield strength cannot be simultaneously obtained.

An object of the present invention is to propose a non-oriented electrical steel sheet capable of simultaneously satisfying superior magnetic properties and high strengths and a method capable of stably performing industrial manufacturing of the steel sheet described above.

In addition, the present invention also proposes a non-oriented electrical steel sheet capable of achieving an object in which rotor strengths are sufficiently increased while superior punchabilities and a preferable iron loss are maintained and a method for manufacturing the steel sheet described above.

[Means for Solving the Problems]

In order to achieve the above objects, the inventors of the present invention carried out various investigations focusing on an age-hardening phenomenon of steel containing Cu, and as a result, means for simultaneously obtaining a superior iron loss and high strengths was finally established.

That is, for example, as disclosed in Japanese Unexamined Patent Application Publication No. 60-238421, it has been believed that although strengths are increased, precipitates in steel suppress the magnetic wall movement and also degrade the iron loss (hysteresis loss). In addition, according to the finding that was first discovered by the inventors of the present invention, particularly in Si-containing steel, Cu precipitates are liable to be grown large and coarse, and as a result, it is difficult to avoid degradation in iron loss.

However, in spite of the conventional knowledge and the novel finding described above, the inventors of the present invention newly found that when an appropriate amount of Cu is added to steel, followed by aging treatment, very fine Cu particles having an average particle diameter of 1 nm to 20 nm can be uniformly precipitated in crystal grain interior, and that the very fine precipitates thus obtained are very effective for improvement in strength, and in addition, do not substantially degrade the iron loss (hysteresis loss).

Furthermore, it was also found that, as for this Cu precipitation, when Cu and Ni are added in combination, since the amount of precipitates generated in heat treatment in steel sheet manufacturing is remarkably reduced, high strengths and a low iron loss can be stably obtained even under wide annealing conditions. Accordingly, the present invention was finally made.

In addition, the inventors of the present invention also succeeded in forming an electrical steel sheet which can impart high strengths to a rotor or the like assembled therefrom while having superior punchabilities. That is, before a punching step, an electrical steel sheet which is not processed by aging treatment and which has a low yield strength is prepared, and aging treatment is performed right after the punching step or after a rotor or the like is assembled, thereby improving strengths of a laminated core assembled from the above steel sheet.

The aspects of the present invention are as follows.

(1) A high-strength non-oriented electrical steel sheet having superior magnetic properties, comprises: on a mass percent basis, C: 0.02% or less (including 0%);

Si: 4.5% or less;

Mn: 3% or less;

Al: 3% or less;

P: 0.5% or less (including 0%);

Ni: 5% or less (including 0%); and

Cu: 0.2% to 4%, wherein the yield stress is not less than CYS (MPa) represented by the following formula 1:

note $$CYS=180+5{,}600[\%\ C]+95[\%\ Si]+50[\%\ Mn]+37[\%\ Al]+435[\%\ P]+25[\%\ Ni]+22d^{-1/2} \quad \text{(Formula 1)}$$

where d is an average grain diameter (mm) of crystal grains.

(2) A high-strength non-oriented electrical steel sheet having superior magnetic properties, comprises: on a mass percent basis, C: 0.02% or less (including 0%);

Si: 4.5% or less;

Mn: 3% or less;

Al: 3% or less;

P: 0.5% or less (including 0%);

Ni: 5% or less (including 0%); and

Cu: 0.2% to 4%, wherein a volume ratio of Cu precipitates in crystal grain interior is in the range of from 0.2% to 2%, and an average particle size of the Cu precipitates is in the range of from 1 to 20 nm.

The average particle size of the Cu precipitates is obtained as a sphere-base diameter by calculation. Hereinafter, the average particle size will be represented in the same manner as described above.

(3) In the high-strength non-oriented electrical steel sheet having superior magnetic properties, according to the above (1), a volume ratio of Cu precipitates in the crystal grains is in the range of from 0.2% to 2%, and an average particle size of the Cu precipitates is in the range of from 1 to 20 nm.

(4) An age-hardenable non-oriented electrical steel sheet having superior punchabilities and magnetic properties (iron loss), comprises: on a mass percent basis, C: 0.02% or less (including 0%);

Si: 4.5% or less;

Mn: 3% or less;

Al: 3% or less;

P: 0.5% or less (including 0%);

Ni: 5% or less (including 0%); and

Cu: 0.2% to 4%,

Wherein, after aging treatment is performed at 500° C. for 10 hours, the yield stress of the steel sheet is not less than CYS (MPa) represented by the following formula 1:

note $$CYS=180+5{,}600[\%\ C]+95[\%\ Si]+50[\%\ Mn]+37[\%\ Al]+435[\%\ P]+25[\%\ Ni]+22d^{-1/2} \quad \text{(Formula 1)}$$

where d is an average grain diameter (mm) of crystal grains.

(5) The non-oriented electrical steel sheet according to one of the above (1) to (4), further comprises at least one of Zr, V, Sb, Sn, Ge, B, Ca, a rare earth element, and Co as a component, wherein the content of each of Zr and V is 0.1% to 3%, the content of each of Sb, Sn, and Ge is 0.002% to 0.5%, the content of each of B, Ca, and the rare earth element is 0.001% to 0.01%, and the content of Co is 0.2% to 5%

(according to the above (1) to (3), the high-strength non-oriented electrical steel sheet having superior magnetic properties is obtained, and according to the above (4), the age-hardenable non-oriented electrical steel sheet having superior punchabilities and magnetic properties is obtained).

Instead of the CYS requirement, the non-oriented electrical steel sheet according to one of the above (1) to (5) may satisfy requirement in which the tensile strength is not less than CTS (MPa) represented by the following formula 2:

note $$CTS=5{,}600[\%\ C]+87[\%\ Si]+15[\%\ Mn]+70[\%\ Al]+430[\%\ P]+37[\%\ Ni]+22d^{-1/2}+230 \quad \text{(Formula 3)}$$

where d is an average grain diameter (mm) of crystal grains.

In the individual inventions described above, the balance of the composition of the steel sheet is preferably composed of Fe and inevitable impurities.

In addition, in the individual inventions described above and preferable embodiments, Ni in an amount of 0.5% or more is preferably contained, and this Ni content is significantly preferable when the CTS is defined as the requirement.

(6) A method for manufacturing a high-strength non-oriented electrical steel sheet having superior magnetic properties, comprises the steps of:

performing hot rolling of a steel slab containing on a mass percent basis,

C: 0.02% or less (including 0%);

Si: 4.5% or less;

Mn: 3% or less;

Al: 3% or less;

P: 0.5% or less (including 0%);

Ni: less than 0.5% (including 0%); and

Cu: 0.2% to 4%, then performing cold rolling or warm rolling to obtain a rolled steel sheet having a final sheet thickness, then performing finish annealing in which heating is performed to a Cu solid solution temperature (temperature of forming a Cu solid solution)+10° C. or more, followed by cooling in which a cooling rate in a temperature range of from the Cu solid solution temperature to 400° C. is 10° C./s or more; and subsequently performing aging treatment at a temperature in the range of from 400 to 650° C.

(7) A method for manufacturing a high-strength non-oriented electrical steel sheet having superior magnetic properties, comprises the steps of:

performing hot rolling of a steel slab containing on a mass percent basis,

C: 0.02% or less (including 0%);

Si: 4.5% or less;

Mn: 3% or less;

Al: 3% or less;

P: 0.5% or less (including 0%);

Ni: 0.5% to 5%; and

Cu: 0.2% to 4%, then performing cold rolling or warm rolling to obtain a rolled steel sheet having a final sheet thickness, then performing finish annealing in which heating is performed to a Cu solid solution temperature+10° C. or more, followed by cooling in which a cooling rate in a temperature range of from the Cu solid solution temperature to 400° C. is 1° C./s or more; and subsequently performing aging treatment at a temperature in the range of from 400 to 650° C.

(8) In the method for manufacturing a high-strength non-oriented electrical steel sheet, according to the above (6) or (7), instead of the "Cu solid solution temperature", Ts (° C.) represented by the following formula 2 is used.

Note $$Ts(°\,C.)=3{,}351/(3.279-\log_{10}[\%\,C])-273 \quad \text{(Formula 2)}$$

(9) In the method for manufacturing a high-strength non-oriented electrical steel sheet having superior magnetic properties, according to one of the above (6) to (8), the steel slab further contains at least one of Zr, V, Sb, Sn, Ge, B, Ca, a rare earth element, and Co, wherein the content of each of Zr and V is 0.1% to 3%, the content of each of Sb, Sn, and Ge is 0.002% to 0.5%, the content of each of B, Ca, and the rare earth element is 0.001% to 0.01%, and the content of Co is 0.2% to 5%.

In addition, the compositions of the inventions according to the above (6) to (9) may be described in a different manner as follows.

That is, in the case in which the steel slab composition described above contains Ni in an amount of 5% or less (including zero; that is, the case is included in which addition is not performed), when the cooling rate in finish annealing is set to 10° C./s or more in a temperature range of from the Cu solid solution temperature or Ts to 400° C., the object of the present invention can be achieved. Furthermore, particularly in the case in which the content of Ni is in the range of from 0.5% to 5%, even if the cooling rate described above is not limited to 10° C./s or more, the object of the present invention can be achieved as long as the cooling rate is set to 1° C./s or more. Of course, even when the cooling rate is set to 10° C./s or more, it is effective that Ni in an amount of 0.5% or more be contained.

(10) A method for manufacturing an age-hardenable non-oriented electrical steel sheet having superior punchabilities and magnetic properties, comprises the steps of:

performing hot rolling of a steel slab containing on a mass percent basis,

C: 0.02% or less (including 0%);

Si: 4.5% or less;

Mn: 3% or less;

Al: 3% or less;

P: 0.5% or less (including 0%);

Ni: less than 0.5% (including 0%); and

Cu: 0.2% to 4%, then performing cold rolling or warm rolling to obtain a rolled steel sheet having a final sheet thickness; and then performing finish annealing in which heating is performed to a Cu solid solution temperature+10° C. or more, followed by cooling in which a cooling rate in a temperature range of from the Cu solid solution temperature to 400° C. is 10° C./s or more.

(11) A method for manufacturing an age-hardenable non-oriented electrical steel sheet having superior punchabilities and magnetic properties, comprises the steps of:

performing hot rolling of a steel slab containing on a mass percent basis,

C: 0.02% or less (including 0%);

Si: 4.5% or less;

Mn: 3% or less;

Al: 3% or less;

P: 0.5% or less (including 0%);

Ni: 0.5% to 5%; and

Cu: 0.2% to 4%, then performing cold rolling or warm rolling to obtain a rolled steel sheet having a final sheet thickness, and then performing finish annealing in which heating is performed to a Cu solid solution temperature+10° C. or more, followed by cooling in which a cooling rate in a temperature range of from the Cu solid solution temperature to 400° C. is 1° C./s or more.

(12) In the method for manufacturing an age-hardenable non-oriented electrical steel sheet, according to the above (10) or (11), instead of the "Cu solid solution temperature", Ts (° C.) represented by the following formula 2 is used:

note $$Ts(°\,C.)=3{,}351/(3.279-\log_{10}[\%\,C])-273 \quad \text{(Formula 2).}$$

(13) In the method for manufacturing an age-hardenable non-oriented electrical steel sheet having superior punchabilities and magnetic properties, according to any one of the above (10) to (12), the steel slab further contains at least one of Zr, V, Sb, Sn, Ge, B, Ca, a rare earth element, and Co, wherein the content of each of Zr and V is 0.1% to 3%, the content of each of Sb, Sn, and Ge is 0.002% to 0.5%, the content of each of B, Ca, and the rare earth element is 0.001% to 0.01%, and the content of Co is 0.2% to 5%.

In the inventions according to the above (10) to (13), the age-hardening treatment described in the inventions according to the above (6) to (9) is not included. The reason for this is based on the concept in that, for example, the age-hardening treatment may be performed at a customer site in a process for manufacturing laminated magnetic cores and the like. However, the present invention described above is not limited to the use described above.

The invention according to the above (4) is also based on the same concept as described above.

BEST MODE FOR CARRYING OUT THE INVENTION

Figure 1:
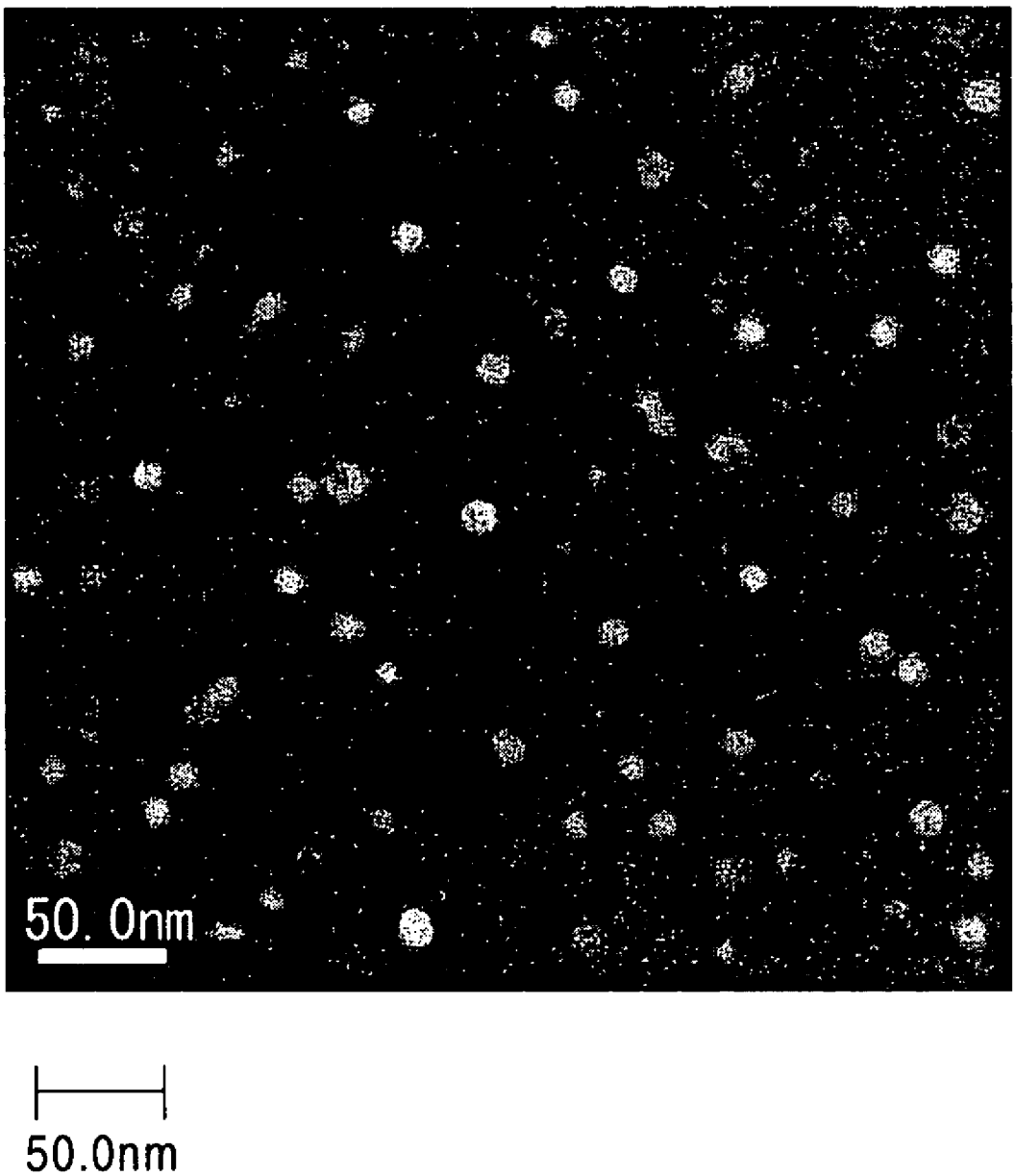
FIG. 1 is a dark field image of precipitated Cu particles observed using a scanning transmission electron microscope (STEM), in which the Cu particles are obtained by finish annealing of 1.8% Si-1.0% Cu steel, followed by aging treatment at 500° C. for 8 hours.

Next, each of the elements of the present invention will be described in detail.

[Composition of Steel Sheet]

First, the ranges of individual components of the composition and the reasons of limitation thereof will be described.

In the present invention, % used for indicating the steel composition is mass percent unless otherwise specifically stated.

C: 0.02% or Less

When the content of C is more than 0.02%, the iron loss is extremely degraded by magnetic aging, and hence the content is limited to 0.02% or less. Alternatively, when the content is preferably set to 0.01% or less or 0.005% or less, and is more preferably set to 0.003% or less, the degradation in iron loss caused by magnetic aging can be decreased to approximately zero.

In addition, it may be C-free, that is, the content may be 0%; however, in general, 0.0005% or more of C is contained.

Si: 4.5% or Less

While being a useful deoxidizing agent, Si has a considerable effect of reducing the iron loss of an electrical steel sheet since the electric resistance is increased. Furthermore, improvement in strength is performed by solid solution strengthening. As a deoxidizing agent, when the content is 0.05% or more, the effect becomes significant. For reduction in iron loss and for solid solution strengthening, the content is set to 0.5% or more and is more preferably set to 1.2% or more. However, when the content is more than 4.5%, degradation in rolling properties of steel sheets becomes serious, and hence the content is limited to 4.5% or less. More preferably, the content is limited to 4.2% or less.

Mn: 3% or Less

While being a useful element for improving strengths by solid solution strengthening, Mn is also a useful element for improving hot brittleness, and the content is preferably set to 0.05% or more. However, excessive addition causes degradation in iron loss, and hence the content is limited to 3% or less. In addition, the content may be set to 3.0% or less. The content of Mn is more preferably 2.0% or less, even more preferably 0.1% to 1.5%, and still even more preferably 1.0% or less.

Al: 3% or Less

Al is a useful element as a deoxidizing agent and is also useful for improving the iron loss. The content of Al is preferably set to 0.5 ppm or more and more preferably set to 0.1% or more. However, excessive addition causes degradation in rolling properties or degradation in punchabilities, and hence the content is preferably set to 3% or less. In addition, the content may be set to 3.0% or less.

However, when the content is 4.0% or less, since the degradation in rolling properties is not so significant, for example, in application in which punching processing is performed before age-hardening treatment, the upper limit may be set to 4.0%.

In addition, the content is more preferably set to 2.5% or less.

P: 0.5% or Less

Since remarkable capability of solid solution strengthening can be obtained by addition of a relatively small amount of P, P is a very useful element for improving strengths, and the content thereof is preferably set to 0.01% or more. On the other hand, since excessive addition may cause embrittlement due to segregation, grain boundary cracking and degradation in rolling properties occur, and hence the content is set to 0.5% or less. In addition, the content may be set to 0.50% or less. The content is more preferably 0.2% or less.

On the other hand, when the content of P is positively decreased, the hot and cold rolling properties can be improved. From this point of view, the content of P may be less than 0.01%. In this case, when it is possible, it may be P-free, that is, the content may be 0%; however, since P is inevitably contained in iron ore or molten iron as an impurity, the content is decreased by dephosphorization treatment in a manufacturing process. A decreased amount of P may be determined in accordance with dephosphorization treatment conditions, treatment cost, and the like, and in general, the lower limit of the content of P is approximately 0.005%.

Cu: 0.2% to 4%

When fine Cu precipitates are formed by aging treatment, the strengths are significantly increased without any substantial degradation in iron loss (hysteresis loss). In order to obtain the effect described above, the content must be 0.2% or more. That is, when the content is less than 0.2%, even when the other structural requirements (composition, manufacturing conditions, and the like) of the present invention are all satisfied, a sufficient precipitate amount cannot be obtained. On the other hand, when the content is more than 4%, since large and coarse precipitates are formed, in addition to considerable degradation in iron loss, increase of strengths is reduced. Accordingly, the content of Cu is set in the range of from 0.2% to 4%. In addition, the upper limit may be set to 4.0% or less.

The preferable lower limit is 0.3% and more preferable lower limit is 0.5%, 0.7%, or 0.8%. In particular, when the content is 0.5% of more, strengthening can be stably obtained.

In addition, the preferable upper limit is 3.0% or less, and more preferably, the upper limit is 2.0% or less.

Ni: 5% or Less

Ni is not an essential element, and the lower limit may be 0%, that is, it may be Ni-free. In addition, even when a small amount of Ni is contained as an inevitable impurity, any problem may not occur.

However, since Ni is a useful element for improving strengths by solid solution strengthening and for improving magnetic properties, the content is preferably set to 0.1% or more.

In addition, when being added to Cu-containing steel as described in the present invention, Ni has an influence on the solid solution state and the precipitation state of Cu and has an effect of stably forming very fine Cu precipitates by aging. That is, in Si-containing steel, in particular, in high Si-containing steel, the growth of Cu precipitates is likely to be facilitated, and due to this phenomenon, it has been believed that insufficient age hardening and degradation in magnetic properties are liable to occur. However, when Ni is present, the formation of large and coarse Cu precipitates is suppressed, and hence the effect of improving the capability of precipitation strengthening by aging can be easily obtained. As a result, the effect of improving strengths by Cu precipitation by aging can be significantly improved, or the range of required process conditions can be widened. In order to obtain this effect, the content is very preferably set to 0.5% or more.

Furthermore, Ni has an effect of decreasing the number of surface defects of hot-rolled steel sheets, called scab (sliver), thereby increasing the yield of steel sheets. The effect described above can be obtained when the content is set to 0.1% or more; however, as is expected, the content is preferably set to 0.5% or more.

However, when the content is more than 5%, the various effects described above are saturated, and the cost is unnecessarily increased; hence, the upper limit is set to 5%. In addition, the upper limit may be set to 5.0%. A more preferable upper limit is 3.5%, and even more preferable upper limit is 3.0%.

In addition, in order to obtain the various effects described above, a more preferable lower limit is 1.0%.

The basic composition of the non-oriented electrical steel sheet of the present invention is as described above, and in addition to the above components, known elements for improving magnetic properties, that is, Zr, V, Sb, Sn, Ge, B, Ca, a rare earth element, and Co, may also be added alone or in combination. However, the content thereof must be controlled so as not to degrade the object of the present invention. In particular, as for Zr and V, the content is 0.1% to 3%, or 0.1% to 3.0%, and preferably 0.1 to 2.0%.

As for Sb, Sn, and Ge, the content is 0.002% to 0.5%, preferably 0.005% to 0.5%, and more preferably 0.01 to 0.5%.

As for Ba, Ca, and a rare earth element, the content is 0.001% to 0.01%.

As for Co, the content is 0.2% to 5%, or 0.2% to 5.0%, and preferably 0.2 to 3.0%.

Since Co has a slightly higher strengthening capability, for example, in application in which punching processing is performed before age-hardening treatment, elements described above other than Co, that is, Zr, V, Sb, Sn, Ge, B, Ca, and a rare earth element, are preferably used alone or in combination. Since also being categorized as an element for improving magnetic properties, Ni may be included in the group described above; however, the effect of Ni is remarkable as compared to that of the elements described above, Ni is separately described.

As elements other than the elements described above, Fe (iron) and inevitable impurities are preferably mentioned. As for S and N as an inevitable impurity, the content thereof is preferably set to approximately 0.01% or less in view of iron loss.

In particular, when a residual amount of S is large, since a CuS precipitate is formed, grain growth in finish annealing is suppressed, thereby degrading the iron loss. Accordingly, the S content is preferably set to at most approximately 0.02%.

As another inevitable impurity, O may be mentioned, and the content thereof is set to approximately 0.02% or less and preferably set to 0.01% or less.

In addition, as inevitable impurities in a broader sense, for example, there are mentioned Nb, Ti, and Cr, which may be contained in some cases due to manufacturing reasons, and the contents thereof are preferably set to approximately 0.005% or less, 0.005% or less, 0.5% or less, respectively.

[Steel Sheet and Cu Precipitates]

The subject of the present invention is basically a non-oriented electrical steel sheet regardless of whether it is processed by age-hardening treatment or not. Although being a ferrite single phase steel in general, the non-oriented electrical steel sheet has various compositions and textures, and they are not specifically limited. The composition and texture may also be freely designed within the scope of the present invention; however, the iron loss value is preferably small, and $W_{15}/W_{50}$ is preferably set to approximately 6 W/kg or less.

In addition, Cu precipitates which will be described below are substantially composed of Cu alone; however, when very fine precipitates are formed, Fe in a solid solution form may be contained in Cu precipitates. The Cu precipitates also include the precipitates as described above.

In some cases, depending on manufacturing conditions, large and coarse Cu precipitates may be observed in grain boundaries; however, as for the amount of precipitates and the average particle size thereof, the precipitates in grains, which practically contribute to the strengthening, are only regarded as the precipitates described above.

[Texture and Properties of Steel Sheet before Age-Hardening Treatment]

In the non-oriented electrical steel sheet of the present invention before age-hardening treatment, it is important that Cu in the steel sheet be present as the solute Cu in a sufficient amount in the steel. When a large amount of fine Cu precipitates is already present before aging treatment, the punchabilities are not only be degraded due to the increase in hardness but also the increase in yield strength by aging treatment performed after punching becomes small. On the other hand, when large Cu precipitates are present in a matrix of crystal grain before aging treatment, besides the deterioration in iron loss, precipitation of Cu during aging treatment occurs on precedent coarse Cu precipitates as nucleuses, and hence larger and coarser Cu precipitates are further formed. As a result, the iron loss is further seriously deteriorated thereby.

When steel is used in which 0.20% to 4.0% or preferably 0.5% to 2.0% of Cu is contained, by aging treatment at 500° C. for 10 hours, fine Cu precipitates having an average particle size of approximately 5 nm can be formed in steel. In more particular, fine Cu precipitates having an average particle size of approximately 1 nm to 20 nm, the average particle size of the Cu precipitates being obtained as a sphere-base diameter, can be precipitated at a volume ratio of 0.2% to 2% with respect to the entire steel sheet. The detail will be explained in description about the steel sheet after aging.

As for the solute Cu before aging, the amount thereof is preferably 0.2% or more and more preferably 0.4% or more, 0.5% or more, or 0.8% or more. The upper limit of the solute Cu is naturally the content of Cu in steel, and the maximum amount of the solute Cu is equal to the maximum content of Cu.

According to the formation of fine Cu precipitates described above, the yield stress can be increased by at least 100 MPa and by approximately 150 MPa under preferable conditions. In particular, when the Cu content is in an optimum range, such as in the range of from 0.5% to 2.0%, or preferably in the range of from 0.7% (0.8% or more is more suitable) to 2.0%, the yield stress can be increased by 150 to 250 MPa.

According to the increase in strength as described above, yield stress YS (MPa) obtained after aging is preferably not less than CYS represented by the following formula 1.

$$CYS=180+5{,}600[\%\ C]+95[\%\ Si]+50[\%\ Mn]+37[\%\ Al]+435[\%\ P]+25[\%\ Ni]+22d^{-1/2} \quad \text{(Formula 1)}$$

In this formula, the coefficient of the term of each element indicates the amount of solid solution strengthening per 1% of each element, and d indicates the average crystal grain diameter (diameter: mm). The measurement method of d is performed as follows. A cross section of a sample is etched by a nital etchant or the like, the cross section being in the thickness direction along a rolling direction (a so-called rolling-direction cross section), and is then observed by an optical microscope. Subsequently, the average area of crystal grains is calculated from the observation field area and the number of crystal grains in the field. Next, d is defined as a circle-base diameter calculated based on the area of the crystal grains.

As the average crystal grain diameter d is decreased, higher strength can be obtained; however, the iron loss is degraded. Accordingly, in accordance with desired strengths and iron loss properties, the crystal grain diameter d is adjusted.

Although depending on a desired iron loss level, an appropriate crystal grain diameter is generally approximately 20 to 200 μm.

By the strengthening as described above, for example, the yield stress of a laminated sheet formed into a rotor core can be increased to 450 MPa or more. The increase in yield strength by the mechanism described above will not cause any considerable degradation in iron loss (increase in iron loss value). For example, the amount of degradation in iron loss represented by $W_{15}/W_{50}$ is 1.5 W/kg or less, and when the Cu amount is relatively small, such as 3% or less, the amount described above is merely 1.0 W/kg or less.

In addition, when the non-oriented electrical steel sheet of the present invention before the age-hardening treatment is processed by age-hardening treatment, the tensile strength (TS) (MPa) is preferably increased to not less than CTS represented by the following formula 3. The requirement described above can be approximately obtained when appropriate Cu precipitation after aging is performed by controlling the composition range and the states of solid solution and precipitation of Cu as described above:

$$CTS=5{,}600[\%\ C]+87[\%\ Si]+15[\%\ Mn]+70[\%\ Al]+430[\%\ P]+37[\%\ Ni]+22d^{-1/2}+230 \quad \text{(Formula 3).}$$

The meanings of the terms of the above formula are the same as those described in the formula 1 except that each of the terms relates to the tensile strength.

[Structure and Properties of Steel Sheet after Age-Hardening Treatment]

In the non-oriented electrical steel sheet of the present invention after age hardening treatment, it is important that Cu in the steel sheet be finely precipitated in steel. Even when the solute Cu (non-precipitated state) is present, higher strengths cannot be achieved. On the contrary, Cu precipitates, which are not finely formed in a predetermined dimensional range, not only degrade the iron loss but also have small contribution to the strengthening. Hence, it is important that without degrading the iron loss, Cu be allowed to be present as fine precipitates which are finely formed in a predetermined dimensional range so as to contribute to the strengthening.

As described above, a preferable Cu precipitation state is that Cu precipitates having an average particle size, which is the sphere-base diameter described above, in the range of from 1 to 20 nm are formed in crystal grain interior at a volume ratio of 0.2% to 2% with respect to the entire steel sheet. In addition, the particle size of Cu precipitates is preferably approximately 20 nm or less.

In general, when the volume ratio of Cu precipitates is high and the average particle size thereof is small, the average distance between particles is decreased. Hence, the increase in strength by aging becomes large. However, although the volume ratio is high, when the average particle size is large, significant increase in strength cannot be expected, and on the contrary, suppression of magnetic wall movement may occur by large and coarse particles in some cases. A volume ratio which can stably realize sufficient strengthening is preferably in the range of from approximately 0.2% to 2%. In addition, the average particle size, which is the sphere-base diameter described above, is preferably in the range of from approximately 1 nm to 20 nm.

In investigations carried out by the inventors of the present invention, the average particle size (the sphere-base diameter described above) of Cu precipitates and the volume ratio thereof were obtained by the following measurements and the statistical work. However, as long as the same result can be obtained in a theoretical point of view, another method may be used in stead of the following methods.

After several images (dark field images) of a sample in a region of approximately 400 by 400 $(nm)^2$ were photographed using a scanning transmission electron microscope, the thickness of the sample being measured beforehand, precipitated Cu particles were recognized by image processing and, from the exterior appearance of each particle, a circle-base diameter thereof was also obtained by calculation. Subsequently, assuming that the diameter thus obtained represented the spherical-base diameter of each particle, the volume of each particle was determined.

The recognition whether an observed particle was a Cu precipitate or not was performed using an energy dispersive X-ray spectrometer (EDX) provided for the scanning transmission electron microscope. Specifically, a precipitate phase was irradiated with electron beams having a diameter of 1 nm or less, and compared to a surrounding matrix phase, the state in which Cu is apparently concentrated was confirmed by the EDX spectrum thus obtained.

From individual particles obtained by image recognition, the volume thereof were calculated based on the assumption in that each particle had a spherical shape, thereby obtaining the sum of the particle volumes. Next, the sum of the particle volumes was divided by the number of the particles, so that the average volume was obtained. From this average volume, the sphere-base diameter was reversely obtained by calculation, thereby obtaining the average particle size described above. In this measurement, all precipitate Cu particles in each field were measured, and the number of fields was determined so as to measure at least 10 particles.

In order to obtain the average particle size, an evaluation method using a so-called circle-base diameter may be used in which the circle-base diameters of individual particles, which were obtained by the observation described above, are simply arithmetically averaged. In the present invention, as the particle size, the sphere-base diameter described above is used; however, since having a value close to that of the diameter described above, the circle-base diameter may be used for a temporary evaluation.

In this measurement, when the observation region was too thin, precipitated particles may be allowed to fall more frequently, and when the region is too thick, precipitated particles in the image of a scanning transmission electron microscope become difficult to recognize; hence, the thickness of the observation region was set in the range of from 30 to 60 nm. In addition, a sample formed from Cu-containing steel for measurement by a scanning transmission electron microscope is generally electrodeposited with Cu atoms on the surface, and by the influence thereof, the amount of precipitates tends to be overestimated. In order to avoid this influence, in the observation, a sample processed by surface cleaning treatment using argon ions was used. FIG. 1 shows an example of a dark field image of a steel sheet containing 1.8% of Si and 1.0% of Cu processed by aging, according to the present invention, photographed by using a scanning transmission electron microscope. Particles shining white are Cu precipitated by the aging.

In addition, as described above, the measurement of the amount of precipitates and the average particle size were performed only for precipitates present inside grains.

In addition, finer Cu precipitates further contribute to strengthening; however, when the particle size of Cu in steel is less than approximately 1 nm, the effect of increasing strengths is saturated, and in addition, it becomes difficult to perform measurement using a scanning transmission electron microscope. Accordingly, in some cases, such severe product control becomes difficult. Hence, in view of industrial manufacturing, the average particle size is preferably controlled in the range of approximately 1 nm or more.

On the other hand, when the average particle size is more than approximately 20 nm, the contribution to strengthening is decreased, and in addition, degradation in iron loss tends to increase; hence, the average particle size is preferably limited to not more than approximately 20 nm.

In addition, the yield stress YS (MPa) of the steel sheet of the present invention after age-hardening treatment is preferably not less than CYS represented by the following formula 1.

$$CYS=180+5{,}600[\%\ C]+95[\%\ Si]+50[\%\ Mn]+37[\%\ Al]+435[\%\ P]+25[\%\ Ni]+22d^{-1/2} \quad \text{(Formula 1)}$$

In addition, the tensile strength TS (MPa) of the steel sheet of the present invention after age-hardening treatment is preferably not less than CTS represented by the following formula 3:

$$CTS=5{,}600[\%\ C]+87[\%\ Si]+15[\%\ Mn]+70[\%\ Al]+430[\%\ P]+37[\%\ Ni]+22d^{-1/2}+230 \quad \text{(Formula 3).}$$

[Manufacturing Method]

In order to manufacture a high-strength non-oriented electrical steel sheet having a superior iron loss, according to the present invention, first, steel melted to have the predetermined composition described above by a converter or an electric furnace is formed into a steel slab through continuous casting or blooming rolling following ingot formation. The composition of the steel slab may be the same as that of a targeted product steel sheet.

Next, the slab thus obtained is hot-rolled and is then processed by hot-rolled sheet annealing whenever necessary.

The hot-rolled steel sheet thus obtained (or hot-rolled annealed steel sheet) is processed by cold rolling once or at least two cold rolling including intermediate annealing to obtain a sheet having a product thickness. In this step, instead of at least one cold rolling step, warm rolling may be performed. The above sequential steps are described by way of example, and the point is to obtain a steel sheet having the composition described above and a predetermined thickness as the sheet product through appropriate casting and processing steps. For example, the following process may be carried out in which casting is performed to form a sheet having a thickness approximately equivalent to that of a common hot-rolled steel sheet, followed by heat treatment whenever necessary, and in addition, cold rolling or warm rolling may then be performed.

According to the present invention, since strengthening is performed in a subsequent step without increasing the Si amount of a starting material, manufacturing can be performed by cold rolling instead of warm rolling. However, since having effects of improving texture and of improving an iron loss and a magnetic flux density, warm rolling may be used.

In addition, at least before final cold rolling (or before warm rolling; hereinafter, the same as above), means for preventing large and coarse Cu precipitates from remaining is preferably taken in order to obtain stable aging properties. When a great amount of large and coarse Cu precipitates remains before the final cold rolling, in a final annealing step which is subsequently performed, a treatment time for reliably turning the large and coarse Cu precipitates into a solid solution form is increased.

As the treatment for preventing large and coarse Cu precipitates from remaining, for example, a method may be mentioned in which a coiling temperature in hot rolling is set to approximately 600° C. or less and preferably set to approximately 550° C. or less.

As another method, a method may be mentioned in which after hot rolling and before final cold rolling, annealing such as hot-rolled sheet annealing or intermediate annealing is performed under predetermined conditions. In this annealing, the large and coarse Cu precipitates are turned into a solid solution form by heating to a Cu solid solution temperature+approximately 10° C. or more, followed by cooling in which a cooling rate in the range of from the Cu solid solution temperature to 400° C. is approximately 5° C./s or more.

As the Cu solid solution temperature, a temperature at which Cu in steel is substantially and sufficiently turned into a solid solution form may be calculated from thermodynamic data, or the temperature may be confirmed by experiments whether Cu in steel is substantially turned into a solid solution form.

As one example, according to "Das Kupfer-Eisen Zustandsdiagramm im Bereich von 650 bis 1,050° C." (G. Salje and M. Feller-Kniepmeier; Z. Metallkde, 69 (1978) pp. 167 to 169), the Cu solid solution temperature can be approximately obtained by the following formula 2.

$$Ts(°\ C.)=3{,}351/(3.279-\log_{10}[\%\ C])-273 \quad \text{(Formula 2)}$$

Accordingly, in the hot-rolled sheet annealing described above, after heating is performed to Ts+approximately 10° C. or more, cooling may be performed at a rate of approximately 5° C./s or more in the range of from Ts to 400° C. In this formula, [% Cu] indicates the content of Cu in steel on a mass percent basis.

The cooling rate indicates an average cooling rate in the temperature range described above.

When the annealing treatment is performed under the above conditions, a coiling temperature in hot rolling is not specifically limited. Of course, while the coiling temperature is set to approximately 600° C. or less and preferably approximately 550° C. or less, the annealing treatment described above may also be performed.

As the annealing treatment, in general, hot-rolled sheet annealing can be advantageously performed in terms of cost. In addition, after hot-rolled sheet annealing is performed under the conditions described above, intermediate annealing may be performed under the conditions similar to those of the above hot-rolled sheet annealing so that the large and coarse Cu precipitates are reliably turned into a solid solution form.

For the steel sheet having a product sheet thickness processed by cold rolling, warm rolling, or the like, finish annealing is performed. Furthermore, after the finish annealing, whenever necessary, an insulating film is applied, dried, and baked.

In addition, whenever necessary, component adjusting treatment such as decarburization annealing, silicon deposition, or the like may be performed, for example, before finish annealing.

In order to turn Cu into a solid solution form in the finish annealing described above, the annealing temperature is set to {a Cu solid solution temperature+approximately 10° C.} or more. When the annealing temperature is less than (a Cu solid solution temperature+approximately 10° C.), large and coarse Cu precipitates present before annealing and Cu precipitates which are formed in a process of the finish annealing remain in a product, and as a result, the iron loss is degraded. In addition, in subsequent aging annealing, since solute Cu is consumed for the growth of the large and coarse Cu precipitates, the amount of the solute Cu itself also becomes insufficient, and hence high strengths cannot be obtained by age-hardening.

Instead of a practical Cu solid solution temperature, for example, Ts obtained by the following approximate formula 2 can be used as described above.

$$Ts(^\circ\text{ C.})=3{,}351/(3.279-\log_{10}[\%\text{ C}])-273 \quad \text{(Formula 2)}$$

When Cu is only contained and Ni is not contained, in particular, in the case of a steel sheet containing less than 0.5% of Ni (including 0), in order to suppress the precipitation of Cu in a cooling step of finish annealing, cooling is performed at a rate of approximately 10° C./s or more from the Cu solid solution temperature (or Ts) to 400° C. In addition, in a temperature range of from an annealing temperature or 900° C. (whichever is lower) to 400° C., the cooling rate is also preferably set to approximately 10° C./s or more.

When the cooling rate is less than approximately 10° C./s, since Cu is also precipitated in a large and coarse form, the iron loss is degraded, and in addition, even in subsequent age-hardening, sufficient increase in strength cannot be obtained. In addition, due to re-precipitation of Cu, the yield strength is increased, and hence the punchabilities are degraded.

On the other hand, in the case in which 0.5% or more of Ni is contained together with Cu, when the cooling rate in the temperature range described above is approximately 1° C./s or more, formation of large and coarse precipitates can be suppressed in cooling, and in subsequent aging treatment, without causing considerable degradation in iron loss, sufficient increase in strength can be obtained. In addition, since the strength before aging treatment can be maintained small, the punchabilities are also superior. That is, when aging treatment is performed for steel containing both Cu and Ni, compared to the case in which Ni is not contained, stable properties can be obtained under more various finish annealing conditions.

Accordingly, in a steel composition containing 0.5% or more of Ni, in a cooling step of finish annealing, the cooling rate in the temperature range of from the Cu solid solution temperature (or Ts) to 400° C. is set to approximately 1° C./s or more. In addition, in the temperature range of from the annealing temperature or 900° C. (whichever is lower) to 400° C., the cooling rate is also preferably set to approximately 1° C./s or more.

In the present invention, it is preferable that a steel texture after finish annealing be substantially a ferrite single phase. When martensite transformation or the like occurs in part of the texture during cooling, due to fine crystal texture formation or residual strain generated in the transformation, the magnetic properties are degraded. It is difficult to totally eliminate the adverse influences described above in subsequent age-heating treatment.

In order to make a steel texture into a ferrite single phase, in cooling in the temperature range of from the Cu solid solution temperature (or Ts) to 400° C., excessively rapid cooling is preferably avoided. Although a particular cooling rate depends on the steel texture, in general, approximately 50° C./s or less is preferable. In addition, more preferable cooling rate is less than 30° C./s.

In the present invention, the cooling rate described above indicates an average cooling rate in the above temperature range.

Primary objects of the finish annealing described above are to remove strain caused by rolling and to obtain a more appropriate crystal grain diameter by recrystallization for obtaining necessary iron loss properties. The appropriate crystal grain diameter is generally in the range of approximately 20 to 200 μm as described above, and in order to obtain this crystal grain diameter, the temperature of the finish annealing is set to approximately 650° C. or more and preferably set to approximately 700° C. or more. On the other hand, when the annealing temperature is more than approximately 1,150° C., large and coarse grains are formed, grain boundary cracking is liable to occur, and degradation in iron loss is increased concomitant whit oxidation and nitridation of a steel sheet surface. Accordingly, the upper limit is preferably set to approximately 1,150° C.

In the finish annealing, a holding time for the heating temperature described above is preferably set to 1 to 300 seconds.

A steel sheet manufactured in accordance with the conditions described above is a steel sheet having the features described in [Texture and Properties of Steel Sheet before Age-Hardening Treatment], a sufficient amount of the solute Cu, and small amount of large and coarse Cu precipitates.

In addition, preferably, by age-hardening treatment at least at 500° C. for 10 hours, a steel sheet can be obtained having a strength not less than CYS (formula 1) or CTS (formula 3) described above and small decrease in iron loss.

The steel sheet of the present invention placed in this state has a small yield strength (primarily depending on the Si content, when the Si contents are 0.3% and 3.5%, the strengths are approximately 200 and 450 MPa, respectively), and hence the punchabilities are superior.

The steel sheet described above is subsequently processed by aging treatment. This aging treatment may be performed at any time, for example, before coating and baking of an insulating film, after baking thereof, or after machining such as punching. Of course, in view of the punchabilities, it is preferable that shipping of the steel sheet be performed before aging and that aging treatment be performed at a customer site after punching; however, aging treatment may be performed in an optional step before shipping so that a steel sheet having a high strength and a low iron loss is to be shipped.

In assembling a rotor using the non-oriented electrical steel sheet of the present invention, for example, aging treatment may be carried out for punched non-oriented electrical steel sheet for laminating, or carried out for laminated rotor core.

In aging treatment, even when the treatment condition is not limited to the condition at 500° C. for 10 hours used as the index described above, as long as the following conditions are satisfied, distribution (average particle size and volume ratio) of the preferable fine Cu precipitates described above can be obtained. In addition, without seriously degrading the iron loss, strengths not less than CYS (formula 1) and CTS (formula 2) can be obtained.

The aging treatment is performed at a temperature in the range of from approximately 400 to 650° C. That is, when the temperature is less than 400° C., precipitation of fine Cu becomes insufficient, and as a result, high strengths cannot be obtained. On the other hand, when the temperature is more than 650° C., since large and coarse Cu precipitates are formed, the iron loss is degraded, and the increase of strength is reduced. A more preferable temperature range is from approximately 450 to 600° C. Although depending on the treatment temperature, a suitable aging time is from approximately 20 seconds to 1,000 hours and preferably approximately 10 minutes to 1,000 hours.

EXAMPLES

Example 1

Steel having the composition shown in Table 1 and containing the balance being iron and inevitable impurities was melted in a converter, followed by continuous casting, thereby forming a slab. Next, this slab was formed into a hot-rolled steel sheet having a thickness of 2.2 mm by hot rolling and was then coiled at 500° C.

After this hot-rolled steel sheet was formed into a cold-rolled steel sheet having a final thickness of 0.5 mm by cold rolling, final annealing was performed under the annealing conditions shown in Table 1. In this step, the average cooling rate from Ts calculated from the formula 2 to 400° C. was set to 20° C./s. In addition, the cooling rate in the range from 900° C. (annealing temperature for steel No. 8 and 10) to 400° C. was approximately equivalent to that described above.

Subsequently, an insulating film was formed. The composition of the steel sheet thus obtained was the same as the slab composition shown in Table 1.

In addition to measurement of the average grain diameter d of the steel sheet (before aging), the iron loss $W_{15}/W_{50}$ (1), the punchabilities, the yield stress YS (1) were evaluated.

Next, after aging treatment was performed for the steel sheet at 500° C. for 10 hours, the properties after the aging treatment were evaluated by the iron loss $W_{15}/W_{50}$ (2) and the yield stress YS (2). Furthermore, a sample was obtained from the steel sheet, and the precipitate amount (volume ratio) of Cu precipitates and the average particle size thereof were evaluated by observation using a scanning transmission electron microscope.

In this evaluation, as described above, the average crystal grain diameter d was obtained as the circle-base diameter by observation of a cross section of the steel sheet using an optical microscope. In addition, the iron loss was measured in accordance with JIS C2550 by an Epstein method using samples obtained along the rolling direction and direction perpendicular thereto, the number of samples in the individual directions being equal to each other. In addition, the punchabilities were measured by the number of ring-shaped samples (inside diameter of 20 mm×outside diameter of 30 mm) punched out from the steel sheet at which a burr height thereof reached 30 μm. The yield strengths were measured along the rolling direction and the direction perpendicular thereto of the steel sheet using a tensile test (at a cross-head speed of 10 mm/min) and were averaged as the yield strength.

In addition, the evaluation of Cu precipitates was performed by observation using a scanning transmission electron microscope as described below. A sample in the form of a flat sheet for the observation by an electron microscope was obtained from a central portion of the steel sheet in the thickness direction, the flat sheet being parallel to the rolling direction, and was then processed by electrolytic polishing using a peroxy acid-methanol base electrolyte to form a flat sheet having a smaller thickness. Next, for cleaning a surface of the sample thus obtained, sputtering was performed for 5 minutes using argon ions for sample preparation. The observation was performed by a scanning transmission mode in which electron beams 1 nm or less in diameter was scanned in an observation field, and three dark fields per each were obtained in which the precipitates were easily recognized. When the observation region is too thin, a falling speed of precipitated particles is increased, and when the region is too thick, precipitated particles in the image of a scanning transmission electron microscope become difficult to recognize; hence, the thickness of the sample in the observation region was set in the range of from 30 to 60 nm. In this measurement, the sample thickness was estimated from a spectrum of electron energy loss. For all the dark field images of 400 nm by 400 nm thus obtained, particle recognition of Cu precipitates was performed by image processing, and the amount of precipitates was calculated using the volume ratio of the volume of all precipitates to the volume of the scope which was observed. In addition, from the average precipitate volume obtained from the volume of all precipitates divided by the number of recognized particles, the sphere-base diameter of the precipitates was obtained as the average particle size.

The evaluation results are shown in Table 2.

TABLE 1

| | Composition (mass %) | | | | | | | | Ts | Temperature of finish annealing | |
|---|---|---|---|---|---|---|---|---|---|---|---|
| No. | C | Si | Mn | Al | P | Ni | Cu | Others | (° C.) | (° C.) | Remarks |
| 1 | 0.002 | 2.5 | 0.10 | 0.20 | 0.02 | 0.01 | 0.1 | — | 510 | 1000 | Comparative example |
| 2 | 0.002 | 2.5 | 0.10 | 0.20 | 0.02 | 0.01 | 0.2 | — | 569 | 1000 | Example |
| 3 | 0.002 | 2.5 | 0.10 | 0.20 | 0.02 | 0.01 | 0.5 | — | 663 | 1000 | Example |
| 4 | 0.002 | 2.5 | 0.10 | 0.20 | 0.02 | 0.01 | 1.5 | — | 807 | 1000 | Example |
| 5 | 0.002 | 2.5 | 0.10 | 0.20 | 0.02 | 0.01 | 2.0 | — | 852 | 1000 | Example |
| 6 | 0.002 | 2.5 | 0.10 | 0.20 | 0.02 | 0.01 | 3.0 | — | 923 | 1000 | Example |
| 7 | 0.002 | 2.5 | 0.10 | 0.20 | 0.02 | 0.01 | 4.2 | — | 989 | 1000 | Comparative example |
| 8 | 0.002 | 0.1 | 0.10 | 0.001 | 0.02 | 0.01 | 1.5 | — | 807 | 820 | Example |
| 9 | 0.002 | 4.5 | 0.10 | 0.20 | 0.02 | 0.01 | 1.5 | — | 807 | 1000 | Example |
| 10 | 0.002 | 0.1 | 0.10 | 0.001 | 0.02 | 0.01 | 0.01 | — | 362 | 820 | Comparative example |
| 11 | 0.002 | 4.5 | 0.10 | 0.20 | 0.02 | 0.01 | 0.01 | — | 362 | 1000 | Comparative example |
| 12 | 0.002 | 2.5 | 3.0 | 0.20 | 0.02 | 0.01 | 1.5 | — | 807 | 1000 | Example |
| 13 | 0.002 | 2.5 | 0.10 | 3.0 | 0.02 | 0.01 | 1.5 | — | 807 | 1000 | Example |
| 14 | 0.002 | 2.5 | 0.10 | 0.20 | 0.50 | 0.01 | 1.5 | — | 807 | 1000 | Example |
| 15 | 0.002 | 2.5 | 0.10 | 0.20 | 0.02 | 5.0 | 1.5 | — | 807 | 900 | Example |
| 16 | 0.002 | 2.5 | 0.10 | 0.20 | 0.02 | 0.002 | 1.5 | Zr: 1 | 807 | 1000 | Example |
| 17 | 0.002 | 2.5 | 0.10 | 0.20 | 0.02 | 0.002 | 1.5 | V: 1 | 807 | 1000 | Example |
| 18 | 0.002 | 2.5 | 0.10 | 0.20 | 0.02 | 0.002 | 1.5 | Sb: 0.05 | 807 | 1000 | Example |
| 19 | 0.002 | 2.5 | 0.10 | 0.20 | 0.02 | 0.002 | 1.5 | Sn: 0.05 | 807 | 1000 | Example |
| 20 | 0.002 | 2.5 | 0.10 | 0.20 | 0.02 | 0.002 | 1.5 | Ge: 0.05 | 807 | 1000 | Example |

TABLE 1-continued

| No. | Composition (mass %) C | Si | Mn | Al | P | Ni | Cu | Others | Ts (° C.) | Temperature of finish annealing (° C.) | Remarks |
|---|---|---|---|---|---|---|---|---|---|---|---|
| 21 | 0.002 | 2.5 | 0.10 | 0.20 | 0.02 | 0.002 | 1.5 | B: 0.005 | 807 | 1000 | Example |
| 22 | 0.002 | 2.5 | 0.10 | 0.20 | 0.02 | 0.002 | 1.5 | Ca: 0.005 | 807 | 1000 | Example |
| 23 | 0.002 | 2.5 | 0.10 | 0.20 | 0.02 | 0.002 | 1.5 | Ce: 0.005 | 807 | 1000 | Example |
| 24 | 0.002 | 2.5 | 0.10 | 0.20 | 0.02 | 0.002 | 1.5 | Co: 0.5 | 807 | 1000 | Example |
| 25 | 0.003 | 2.2 | 0.10 | 0.35 | 0.02 | 0.01 | 0.6 | Zr: 0.12<br>V: 0.12<br>Ca: 0.002 | 684 | 1000 | Example |
| 26 | 0.002 | 2.2 | 0.10 | 0.35 | 0.02 | 0.01 | 0.6 | Sb: 0.02<br>Sn: 0.03<br>B: 0.001 | 684 | 1000 | Example |
| 27 | 0.002 | 2.2 | 0.10 | 0.35 | 0.02 | 0.01 | 0.6 | Ge: 0.005<br>Ce: 0.005<br>Co: 0.25 | 684 | 1000 | Example |

TABLE 2

| No. | Crystal grain diameter d (mm) | Number of punching (Ten thousand times) | Properties of steel sheet before aging YS (1) (MPa) | $W_{15/50}$ (1) (W/kg) | CYS (MPa) | Properties of steel sheet after aging YS (2) (MPa) | $W_{15/50}$ (2) (W/kg) | Change amount ΔYS (2) − (1) | ΔW (2) − (1) | Cu precipitation state Volume ratio (vol %) | Size (nm) | Remarks |
|---|---|---|---|---|---|---|---|---|---|---|---|---|
| 1 | 0.10 | 83 | 385 | 2.7 | 520 | 420 | 2.7 | 35 | 0.0 | 0.02 | 9 | Comparative example |
| 2 | 0.10 | 81 | 365 | 2.5 | 520 | 520 | 2.6 | 155 | 0.1 | 0.20 | 6 | Example |
| 3 | 0.10 | 89 | 370 | 2.5 | 520 | 612 | 2.7 | 242 | 0.2 | 0.41 | 6 | Example |
| 4 | 0.10 | 92 | 370 | 2.5 | 520 | 620 | 2.7 | 250 | 0.2 | 1.20 | 15 | Example |
| 5 | 0.10 | 86 | 374 | 2.4 | 520 | 608 | 2.6 | 234 | 0.2 | 1.34 | 18 | Example |
| 6 | 0.10 | 80 | 370 | 2.3 | 520 | 522 | 2.6 | 152 | 0.3 | 1.40 | 20 | Example |
| 7 | 0.10 | 65 | 412 | 3.8 | 520 | 440 | 4.5 | 28 | 0.7 | 2.40 | 50 | Comparative example |
| 8 | 0.03 | 108 | 215 | 5.9 | 342 | 427 | 6.1 | 212 | 0.2 | 0.26 | 5 | Example |
| 9 | 0.10 | 65 | 550 | 2.0 | 710 | 850 | 2.2 | 300 | 0.2 | 1.34 | 18 | Example |
| 10 | 0.03 | 103 | 206 | 6.0 | 342 | 225 | 6.1 | 19 | 0.1 | 0.00 | — | Comparative example |
| 11 | 0.10 | 28 | 610 | 2.2 | 710 | 612 | 2.2 | 2 | 0.0 | 0.00 | — | Comparative example |
| 12 | 0.10 | 72 | 520 | 2.3 | 665 | 670 | 2.8 | 150 | 0.5 | 1.20 | 12 | Example |
| 13 | 0.10 | 69 | 470 | 2.0 | 623 | 670 | 2.3 | 200 | 0.3 | 1.10 | 12 | Example |
| 14 | 0.10 | 65 | 565 | 2.4 | 728 | 780 | 2.7 | 215 | 0.3 | 1.25 | 15 | Example |
| 15 | 0.10 | 85 | 495 | 2.2 | 644 | 680 | 2.6 | 185 | 0.4 | 0.90 | 7 | Example |
| 16 | 0.10 | 73 | 468 | 2.3 | 520 | 620 | 2.5 | 152 | 0.2 | 1.00 | 18 | Example |
| 17 | 0.10 | 69 | 450 | 2.3 | 520 | 615 | 2.5 | 165 | 0.2 | 1.10 | 15 | Example |
| 18 | 0.10 | 91 | 377 | 2.4 | 520 | 618 | 2.4 | 241 | 0.0 | 0.90 | 8 | Example |
| 19 | 0.10 | 93 | 360 | 2.4 | 520 | 621 | 2.5 | 261 | 0.1 | 0.85 | 7 | Example |
| 20 | 0.10 | 85 | 360 | 2.3 | 520 | 612 | 2.6 | 252 | 0.3 | 1.20 | 10 | Example |
| 21 | 0.10 | 80 | 365 | 2.5 | 520 | 615 | 2.6 | 250 | 0.1 | 0.80 | 7 | Example |
| 22 | 0.10 | 93 | 354 | 2.5 | 520 | 613 | 2.6 | 259 | 0.1 | 1.20 | 8 | Example |
| 23 | 0.10 | 85 | 370 | 2.5 | 520 | 605 | 2.6 | 235 | 0.1 | 1.40 | 9 | Example |
| 24 | 0.10 | 78 | 409 | 2.3 | 520 | 607 | 2.5 | 198 | 0.2 | 1.20 | 12 | Example |
| 25 | 0.10 | 98 | 355 | 3.1 | 520 | 570 | 3.3 | 215 | 0.2 | 0.60 | 8 | Example |
| 26 | 0.10 | 95 | 350 | 3.0 | 520 | 530 | 3.2 | 180 | 0.2 | 0.50 | 7 | Example |
| 27 | 0.10 | 82 | 362 | 3.1 | 520 | 555 | 3.4 | 193 | 0.3 | 0.65 | 8 | Example |

As shown in Table 1, all steel sheets having the compositions controlled within the scope of the present invention had a high strength and a superior iron loss after aging. In the steel of the present invention, the amount and the average particle size of Cu precipitates, which functioned as the strengthening factors, were within the scope of the present invention. In addition, according to the steel of the present invention, by age-hardening treatment, the yield strength was increased by 150 MPa or more, and in addition, the iron loss was decreased by 0.5 W/kg or less.

In addition, the tensile strength of all the steel sheets of the present invention after aging was not less than CTS.

On the other hand, in conventional steel (comparative example: No. 10) having a low Si component and conventional steel (comparative example: No. 11) having a high Si component, although a superior iron loss could be obtained, the strength was inferior to that of steel of the present invention containing an equivalent amount of Si to that of the steel mentioned above. In addition, steel (comparative example: No. 7) containing excessive Cu had a poor iron loss before aging and a small increase in strength after aging as compared to steel of the present invention containing an equivalent amount of Si to that of the above-mentioned steel.

Example 2

Steel having the composition shown in Table 3 was melted in a converter, followed by continuous casting, thereby forming a slab. In all the slabs thus obtained, the balance was iron and inevitable impurities.

Next, after the slab was formed into a hot-rolled steel sheet having a thickness of 1.8 mm by hot rolling and was then coiled at 500° C., hot-rolled sheet annealing was performed at 800° C. for 5 hours for this hot-rolled steel sheet thus obtained, and subsequently, by a single cold rolling method, a cold-rolled steel sheet having a thickness of 0.35 mm was formed.

Furthermore, final annealing was performed for this cold-rolled steel sheet thus obtained under the annealing conditions shown in Table 4, and after an insulating film is formed, aging treatment shown in Table 4 was further performed. In this Table, the cooling rate was the average cooling rate from Ts calculated from the formula 2 to 400° C.

The composition of the steel sheet was the same as the composition of the slab. In addition, the cooling rate in the range of from the temperature of finish annealing to 400° C. was approximately equivalent to that shown in Table 4.

As was the case of Example 1, the average crystal grain diameter d, the iron losses $W_{15}/W_{50}$ and yield stress YS (MPa) before and after aging, and the amount (volume ratio) and the average particle size of Cu precipitates after aging treatment were evaluated for the steel sheets thus obtained. The results are shown in Table 4.

As shown in Table 4, in the steel sheets which were each controlled so that the steel composition, the finish annealing conditions, and the aging conditions were within the scope of the present invention, the amount and the average particle size of the Cu precipitates were-within the specified range, and steel sheets (after aging) having a superior iron loss and a high strength could be obtained.

The steel sheets of the present invention all had a tensile strength not less than CTS after aging. In addition, in all the steel sheets of the present invention, by age-hardening treatment, the yield strength was increased by 150 MPa or more, ant the iron loss was decreased by 0.7 W/kg or less.

However, in conventional steel b and d (comparative examples; Nos. 10 and 19) which contained no Cu, although a superior iron loss could be obtained, a high strength by Cu precipitation can not be obtained.

In addition, when the temperature of finish annealing is too low (comparative examples: Nos. 1 and 11), since Cu in a solid solution form is not sufficiently formed in annealing, the amount of Cu precipitates by aging became insufficient, and as a result, a high strength can not be obtained. In addition, when the cooling rate of the finish annealing is too low (comparative examples: Nos. 4 and 14), since the size of Cu precipitates was large, the iron loss was degraded, and in addition, a high strength can not be obtained.

Furthermore, when the aging temperature was too low (comparative examples: Nos. 5 and 15), since the amount of Cu precipitates was insufficient, a high strength could not be obtained, and when the aging temperature was too high (comparative examples: Nos. 9 and 18), since large and coarse Cu precipitates were considerably formed, the iron loss was degraded, and a high strength could not also be obtained.

TABLE 3

| Steel | Composition (mass %) | | | | | | | | Ts | Classification of |
|---|---|---|---|---|---|---|---|---|---|---|
| ID | C | Si | Mn | Al | P | Ni | Cu | Others | (° C.) | components |
| a | 0.003 | 0.12 | 0.10 | 0.20 | 0.05 | 0.1 | 1.5 | — | 807 | Within scope of invention |
| b | 0.003 | 0.12 | 0.10 | 0.20 | 0.05 | 0.1 | 0.02 | — | 400 | Out of scope of invention |
| c | 0.002 | 3.2 | 0.25 | 0.35 | 0.01 | 0.0 | 2.8 | — | 910 | Within scope of invention |
| d | 0.003 | 3.1 | 0.26 | 0.35 | 0.01 | 0.1 | 0.1 | — | 510 | Out of scope of invention |

TABLE 4

| | | | Finish annealing | | Temperature | Crystal | | Properties of steel sheet after aging | | Cu precipitation state | | |
|---|---|---|---|---|---|---|---|---|---|---|---|---|
| No. | Steel ID | Ts (° C.) | Temperature (° C.) | Cooling rate (° C./s) | of aging treatment (° C.) | grain diameter (mm) | CYS (MPa) | YS (2) (MPa) | $W_{15/50}$ (2) (W/kg) | Volume ratio (vol %) | Size (nm) | Remarks |
| 1 | a | 807 | 800 | 10 | 500 | 0.025 | 384 | 314 | 6.7 | 0.15 | 15 | Comparative example |
| 2 | | | 817 | 10 | 500 | 0.03 | 372 | 455 | 4.9 | 0.30 | 7 | Example |
| 3 | | | 850 | 10 | 500 | 0.035 | 362 | 451 | 4.8 | 0.30 | 5 | Example |
| 4 | | | 817 | 5 | 500 | 0.03 | 372 | 310 | 6.5 | 0.50 | 25 | Comparative example |
| 5 | | | 817 | 10 | 350 | 0.03 | 372 | 258 | 4.9 | 0.01 | 3 | Comparative example |
| 6 | | | 817 | 15 | 400 | 0.03 | 372 | 545 | 4.8 | 0.20 | 3 | Example |
| 7 | | | 817 | 10 | 400 | 0.03 | 372 | 452 | 4.8 | 0.30 | 5 | Example |
| 8 | | | 817 | 10 | 650 | 0.03 | 372 | 440 | 4.8 | 1.90 | 18 | Example |
| 9 | | | 817 | 10 | 700 | 0.03 | 372 | 261 | 6.9 | 1.00 | 35 | Comparative example |
| 10 | b | 400 | 817 | 10 | 500 | 0.03 | 372 | 225 | 4.8 | 0.00 | — | Comparative example |

TABLE 4-continued

| No. | Steel ID | Ts (° C.) | Finish annealing Temperature (° C.) | Finish annealing Cooling rate (° C./s) | Temperature of aging treatment (° C.) | Crystal grain diameter (mm) | CYS (MPa) | Properties of steel sheet after aging YS (2) (MPa) | Properties of steel sheet after aging $W_{15/50}$ (2) (W/kg) | Cu precipitation state Volume ratio (vol %) | Cu precipitation state Size (nm) | Remarks |
|---|---|---|---|---|---|---|---|---|---|---|---|---|
| 11 | c | 910 | 900 | 10 | 500 | 0.055 | 619 | 505 | 4.6 | 0.15 | 12 | Comparative example |
| 12 | | | 1000 | 10 | 500 | 0.13 | 586 | 595 | 2.6 | 1.80 | 13 | Example |
| 13 | | | 950 | 10 | 500 | 0.08 | 603 | 640 | 2.6 | 1.70 | 12 | Example |
| 14 | | | 950 | 5 | 500 | 0.08 | 603 | 587 | 4.9 | 1.90 | 25 | Comparative example |
| 15 | | | 950 | 10 | 350 | 0.08 | 603 | 465 | 2.5 | 0.00 | — | Comparative example |
| 16 | | | 950 | 10 | 400 | 0.08 | 603 | 650 | 2.6 | 0.35 | 5 | Example |
| 17 | | | 950 | 10 | 650 | 0.08 | 603 | 610 | 2.9 | 1.90 | 17 | Example |
| 18 | | | 950 | 10 | 700 | 0.08 | 603 | 515 | 5.2 | 0.65 | 30 | Comparative example |
| 19 | d | 510 | 950 | 10 | 500 | 0.08 | 602 | 470 | 2.4 | 0.00 | — | Comparative example |

Example 3

Steel slabs were prepared containing 3% of Si, 0.2% of Mn, and 0.3% of Al as base components and containing various amounts of Cu and Ni. The compositions of the steel slabs are shown in Table 5, and the balance thereof was iron and inevitable impurities.

The slabs were each processed by hot rolling to form a sheet having a thickness of 2.0 mm and were then coiled at 550° C. Subsequently, hot-rolled sheet annealing was performed at 1,000° C. for 300 seconds or was not performed. Cooling after the hot-rolled sheet annealing was performed at an average cooling rate of 20° C./s in the range of from at least Ts (obtained from the formula 2) to 400° C.

Subsequently, pickling and cold rolling for forming a steel sheet having a finish sheet thickness of 0.35 mm were performed. Furthermore, after finish annealing was performed in which a holding temperature of 950° C. was maintained for 30 seconds, cooling was performed at a cooling rate of 6° C./s in a temperature range of from 900 to 400° C. The cooling rate in the range of from Ts to 400° C. was approximately equivalent to that described above.

Next, after an insulating film was applied and baked, heating treatment at 550° C. for 5 hours was performed for aging.

The average crystal grain diameter, the iron loss properties, and the mechanical properties of the steel sheets thus obtained were evaluated. The compositions of the steel sheets were approximately equivalent to those of the respective slabs. The iron loss was measured by an Epstein method using samples obtained along the rolling direction and direction perpendicular thereto, the number of samples in the individual directions being equal to each other. The mechanical properties were measured using samples obtained along the rolling direction and the direction perpendicular thereto, and the evaluation was performed by the average value obtained therefrom. The details of the individual investigations were the same as those described in Example 1. The results are shown in Table 5.

In addition, as conventional electrical steel sheets formed to have a high tensile strength by known solid solution strengthening, grain-refining strengthening, precipitation strengthening, or the like, the following steel sheets were experimentally formed.

That is, as an example in that solid solution strengthening was used, a steel slab was hot-rolled and then processed by hot-rolled sheet annealing at 900° C. for 30 seconds, and warm rolling was then performed at 400° C. to form a steel sheet having a thickness of 0.35 mm, followed by finish annealing at 950° C. for 30 seconds. As shown in Table 6, the steel slab described above contained 0.002% of C, 4.5% of Si, 0.2% of Mn, 0.01% of P, 0.6% of Al, 1.0% of W, 1.0% of Mo, and the balance being iron and inevitable impurities.

In addition, as an example in that solid solution strengthening and grain-refining strengthening were used, steel was hot-rolled and then cold-rolled to form a steel sheet having a thickness of 0.35 mm, followed by finish annealing at 800° C. for 30 seconds. As shown in Table 6, the steel described above contained 0.005% of C, 3% of Si, 0.2% of Mn, 0.05% of P, 4.5% of Ni, and the balance being iron and inevitable impurities.

Furthermore, as an example in that precipitation strengthening by carbides was used, steel was hot-rolled and then cold-rolled to form a steel sheet having a thickness of 0.35 mm, followed by finish annealing at 750° C. for 30 seconds. As shown in Table 6, the steel described above contained 0.03% of C, 3.2% of Si, 0.2% of Mn, 0.02% of P, 0.65% of Al, 0.003% of N, 0.018% of Nb, 0.022% of Zr, and the balance being iron and inevitable impurities.

In all the examples described above, aging treatment was not performed.

TABLE 5

| No. | Steel ID | Steel composition (Mass percent) C | Si | Mn | P | S | Al | Cu | Ni | N | Ts (° C.) | Crystal grain diameter (mm) | Properties of steel sheet after aging $W_{15/50}$ (W/kg) | $B_{50}$ (T) | TS (MPa) | CTS (MPa) | TS-CTS (MPa) | Remarks |
|---|---|---|---|---|---|---|---|---|---|---|---|---|---|---|---|---|---|---|
| 1 | A | 0.001 | 3.0 | 0.15 | 0.01 | 0.002 | 0.31 | — | — | 0.003 | — | 0.083 | 2.45 | 1.69 | 501 | 601 | −100 | Comparative example |
| 2 | B | 0.002 | 3.01 | 0.18 | 0.02 | 0.002 | 0.28 | 0.24 | — | 0.002 | 586 | 0.070 | 2.43 | 1.68 | 527 | 617 | −90 | Comparative example |
| 3 | C | 0.003 | 3.2 | 0.21 | 0.01 | 0.003 | 0.28 | 1.2 | — | 0.002 | 774 | 0.085 | 3.46 | 1.68 | 681 | 628 | 53 | Comparative example |
| 4 | D | 0.003 | 3.14 | 0.2 | 0.02 | 0.002 | 0.32 | 3.8 | — | 0.002 | 968 | 0.093 | 5.59 | 1.64 | 764 | 626 | 138 | Comparative example |
| 5 | E | 0.002 | 3.08 | 0.19 | 0.01 | 0.003 | 0.28 | — | 2.5 | 0.003 | — | 0.085 | 2.20 | 1.70 | 604 | 704 | −100 | Comparative example |
| 6 | F | 0.002 | 3.06 | 0.18 | 0.02 | 0.002 | 0.29 | 0.11 | 1.0 | 0.002 | 518 | 0.084 | 2.34 | 1.69 | 563 | 652 | −90 | Comparative example |
| 7 | G | 0.002 | 3.08 | 0.19 | 0.02 | 0.001 | 0.29 | 0.22 | 0.6 | 0.003 | 578 | 0.091 | 2.40 | 1.70 | 688 | 636 | 52 | Example |
| 8 | H | 0.003 | 3.1 | 0.18 | 0.02 | 0.002 | 0.29 | 0.33 | 2.5 | 0.002 | 618 | 0.094 | 2.20 | 1.70 | 769 | 712 | 57 | Example |
| 9 | I | 0.002 | 3.04 | 0.21 | 0.01 | 0.003 | 0.3 | 1.1 | 1.2 | 0.002 | 762 | 0.088 | 2.43 | 1.69 | 837 | 653 | 184 | Example |
| 10 | J | 0.002 | 3.06 | 0.2 | 0.02 | 0.002 | 0.31 | 1.2 | 2.6 | 0.003 | 774 | 0.087 | 2.25 | 1.69 | 921 | 712 | 210 | Example |
| 11 | K | 0.002 | 3.08 | 0.21 | 0.02 | 0.002 | 0.28 | 1.2 | 3.3 | 0.003 | 774 | 0.083 | 2.23 | 1.69 | 949 | 739 | 210 | Example |
| 12 | L | 0.003 | 3.1 | 0.21 | 0.02 | 0.002 | 0.28 | 3.0 | 1.0 | 0.002 | 923 | 0.085 | 3.33 | 1.66 | 1009 | 660 | 349 | Example |
| 13 | M | 0.003 | 3.12 | 0.18 | 0.02 | 0.001 | 0.27 | 2.6 | 2.3 | 0.002 | 897 | 0.088 | 2.96 | 1.67 | 1053 | 708 | 345 | Example |
| 14 | N | 0.003 | 3.06 | 0.2 | 0.02 | 0.001 | 0.29 | 2.8 | 4.5 | 0.002 | 910 | 0.091 | 2.80 | 1.65 | 1164 | 784 | 379 | Example |

TABLE 6

| No. | Steel ID | Steel composition (Mass percent) C | Si | Mn | P | S | Al | Cu | Ni | N | Others | Crystal grain diameter (mm) | Properties of steel sheet after aging $W_{15/50}$ (W/kg) | $B_{50}$ (T) | TS (MPa) | CTS (MPa) | TS-CTS (MPa) | Remarks |
|---|---|---|---|---|---|---|---|---|---|---|---|---|---|---|---|---|---|---|
| 15 | O | 0.002 | 4.5 | 0.2 | 0.01 | 0.002 | 0.61 | 0 | 0 | 0.002 | W: 1.0, Mo: 1.0 | 0.065 | 3.65 | 1.60 | 735 | 769 | −34 | Conventional example |
| 16 | P | 0.005 | 3 | 0.2 | 0.05 | 0.003 | 0 | 0 | 4.5 | 0.002 | — | 0.041 | 5.90 | 1.66 | 688 | 819 | −131 | Conventional example |
| 17 | Q | 0.03 | 3.2 | 0.2 | 0.02 | 0.003 | 0.65 | 0 | 0 | 0.003 | Nb: 0.016, Zr: 0.017 | 0.034 | 7.31 | 1.66 | 702 | 855 | −153 | Conventional example |

Steel sheets Nos. 7 to 14 according to the present invention obtained a significantly high strength while having superior magnetic properties approximately equivalent to those of steel sheet No. 1 which was a comparative example having the base composition. Furthermore, even when being compared to steel sheets Nos. 15 to 17, which were conventional high-strength electrical steel sheets, the steel sheets described above had a significantly low iron loss or a high magnetic flux density, and the compatibility of strength and magnetic properties was superior.

In addition, in all the steel sheets of the present invention, the yield stress after aging was not less than CYS. In addition, according to all the steel sheets of the present invention, the volume ratio of Cu precipitates was in the range of from 0.3% to 1.9%, and the average particle size was in the range of from 1.5 to 20 nm. Furthermore, in the steel sheets of the present invention, by age-hardening treatment, the yield strength was increased by 150 MPa or more, and the iron loss was decreased by 1.0 W/kg or less.

Example 4

Steel C of a comparative example and steel J of an example of the present invention shown in Table 5 were sequentially processed by hot rolling into a sheet having a thickness of 2.0 mm, hot-rolled sheet annealing at 1,000° C. for 300 seconds, cooling under the same conditions as those in Example 3, pickling, and cold rolling into a sheet having a finish sheet thickness of 0.35 mm. Furthermore, finish annealing was performed in which a holding temperature of 950° C. was maintained for 30 seconds, followed by cooling in a temperature range of from 900 to 400° C. at an average cooling rate which was changed in accordance with various conditions shown in Table 7. In this case, the average cooling rate in a temperature range of from Ts (obtained from the formula 2) to 400° C. was approximately equivalent to that described above.

Subsequently, an insulating film was applied and baked, thereby forming an annealed steel sheet. The annealed steel sheet thus obtained was processed by heat treatment at 550° C. for 5 hours for aging. The average crystal grain diameter, the iron loss, and the mechanical properties of the steel sheet thus obtained were evaluated. The details of the individual investigation were the same as those described in Example 1. In addition, the composition of the steel sheet was approximately equivalent to that of the corresponding slab.

Figure 2:
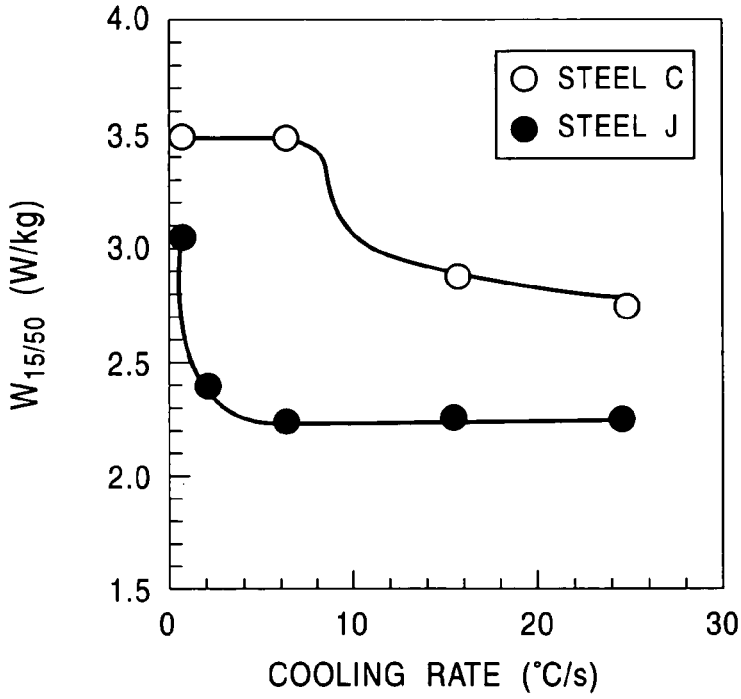
FIG. 2 is a graph showing the influence of a cooling rate in finish annealing on an iron loss obtained after aging treatment.
Figure 3:
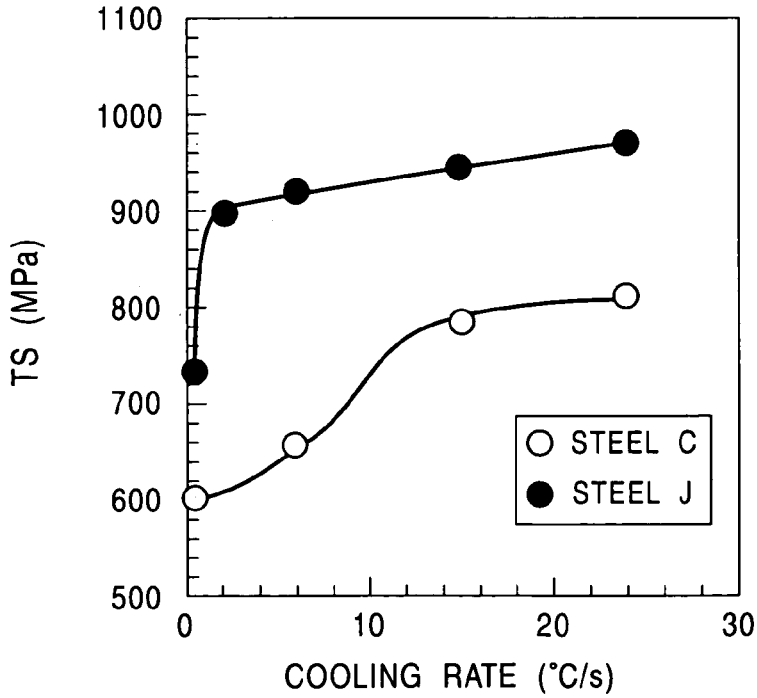
FIG. 3 is a graph showing the influence of a cooling rate in finish annealing on the tensile strength obtained after aging treatment.

The results are shown in Table 7 and FIGS. 2 and 3.

TABLE 7

| No. | Steel ID | Temperature of finish annealing (° C.) | Holding time (s) | Cooling rate (° C./s) | Crystal grain diameter (mm) | Aging temperature (° C.) | Properties of Steel sheet after aging $W_{15/50}$ (W/kg) | $B_{50}$ (T) | TS (MPa) | CTS (MPa) | TS-CTS (MPa) | Remarks |
|---|---|---|---|---|---|---|---|---|---|---|---|---|
| 18 | C | 950 | 60 | 24 | 0.083 | 550 | 2.74 | 1.68 | 812 | 629 | 184 | Example |
| 19 | | 950 | 60 | 15 | 0.085 | 550 | 2.86 | 1.68 | 785 | 628 | 158 | Example |
| 20 | | 950 | 60 | 6 | 0.081 | 550 | 3.46 | 1.68 | 657 | 630 | 27 | Comparative example |
| 21 | | 950 | 60 | 0.5 | 0.090 | 550 | 3.47 | 1.67 | 601 | 626 | −26 | Comparative example |
| 22 | J | 950 | 60 | 24 | 0.094 | 550 | 2.25 | 1.7 | 970 | 709 | 262 | Example |
| 23 | | 950 | 60 | 15 | 0.092 | 550 | 2.25 | 1.69 | 945 | 709 | 236 | Example |
| 24 | | 950 | 60 | 6 | 0.089 | 550 | 2.25 | 1.7 | 920 | 711 | 210 | Example |
| 25 | | 950 | 60 | 2 | 0.085 | 550 | 2.39 | 1.7 | 896 | 712 | 184 | Example |
| 26 | | 950 | 60 | 0.5 | 0.088 | 550 | 3.04 | 1.7 | 738 | 711 | 53 | Comparative example |

As can be seen from the table and figures, steel C showed superior magnetic properties and a high strength at a relatively high cooling rate (steel sheets Nos. 18 and 19) of 10° C./s or more; however, at a cooling rate of less than 10° C./s, the iron loss was degraded, and the strength was liable to decrease. On the other hand, in steel J of the example containing an appropriate amount of Ni in addition to Cu, as can be seen from the results of steel sheets Nos. 22 to 25, superior magnetic properties and a high strength could be stably and simultaneously obtained under various cooling-rate conditions.

In addition, the yield stress after aging of all the steel sheets of the present invention was not less than CYS. In addition, in all the steel sheets of the present invention, the volume ratio of Cu precipitates was 0.6% to 1.2%, and the average particle size thereof was in the range of from 5 to 15 nm. Furthermore, in all the steel sheets of the present invention, by age-hardening treatment, the yield strength was increased by 190 MPa or more, and in addition, the iron loss was decreased by 0.4 W/kg or less.

Example 5

Steel having the composition shown in Table 8 and the balance being iron and inevitable impurities was sequentially processed by hot rolling into a sheet having a thickness of 2.0 mm, followed by hot-rolled sheet annealing for 300 seconds at a temperature shown in Table 9 or by non-annealing. Subsequently, cooling under the same conditions as those in Example 3 was performed, and pickling and cold rolling were then performed so as to form a sheet having a predetermined thickness.

Furthermore, finish annealing was performed in which a constant temperature shown in Table 9 was maintained for 30 seconds, followed by cooling in a temperature range of from 900 to 400° C. at an average cooling rate of 6° C./s. In this case, the average cooling rate in a temperature range of from Ts (obtained from the formula 2) to 400° C. was approximately equivalent to that described above.

Subsequently, an insulating film was applied and baked, thereby forming an annealed sheet. The annealed sheet thus obtained was processed by aging treatment at a temperature shown in Table 9 for 10 hours for aging.

The average crystal grain diameter, the iron loss, and the mechanical properties of the steel sheet thus obtained were evaluated. The results are also shown in Table 9. In addition, the composition of the steel sheet was approximately equivalent to that of the corresponding slab. From Table 9, it was found that all samples of individual steel sheet grades have superior magnetic properties and significantly high strength properties.

In addition, the yield stress after aging of all the steel sheets of the present invention was not less than CYS. In addition, in the steel sheets of the present invention, the volume ratio of Cu precipitates was 0.2% to 0.9%, and the average particle size thereof was in the range of from 3 to 8 nm. Furthermore, in all the steel sheets of the present invention, by age-hardening treatment, the yield strength was increased by 150 MPa or more, and in addition, the iron loss was decreased by 0.4 W/kg or less.

TABLE 8

| No. | Steel ID | C | Si | Mn | P | S | Al | Cu | Ni | N | Others | Remarks |
|---|---|---|---|---|---|---|---|---|---|---|---|---|
| | | Steel composition (Mass percent) | | | | | | | | | | |
| 26 | R | 0.003 | 0.35 | 0.15 | 0.15 | 0.002 | 0.001 | 0.55 | 1.1 | 0.003 | | Example |
| 27 | S | 0.002 | 1.50 | 0.18 | 0.02 | 0.002 | 0.28 | 1.5 | 1.0 | 0.002 | | Example |
| 28 | T | 0.003 | 4.11 | 0.21 | 0.01 | 0.003 | 0.28 | 1.0 | 1.1 | 0.002 | | Example |
| 29 | U | 0.003 | 0.55 | 0.55 | 0.04 | 0.002 | 0.55 | 0.8 | 1.2 | 0.002 | | Example |
| 30 | V | 0.002 | 3.08 | 0.19 | 0.01 | 0.003 | 1.1 | 0.8 | 2 | 0.003 | Sb: 0.01 | Example |
| 31 | W | 0.002 | 3.06 | 0.18 | 0.02 | 0.002 | 0.98 | 1.1 | 2.1 | 0.002 | Sn: 0.05 | Example |
| 32 | X | 0.002 | 3.08 | 0.19 | 0.02 | 0.001 | 0.29 | 1.5 | 0.6 | 0.003 | B: 0.002 | Example |
| 33 | Y | 0.003 | 3.10 | 0.18 | 0.02 | 0.002 | 0.29 | 0.33 | 2.5 | 0.002 | Ca: 0.003 | Example |
| 34 | Z | 0.002 | 3.04 | 0.21 | 0.01 | 0.003 | 0.3 | 1.1 | 1.2 | 0.002 | Co: 3.2 | Example |
| 35 | e | 0.001 | 3.05 | 0.15 | 0.01 | 0.001 | 0.31 | 1.5 | 1.5 | 0.001 | Zr: 0.13<br>V: 0.13<br>Ge: 0.003<br>La: 0.003 | Example |

TABLE 9

| No. | Temperature of hot-rolled sheet annealing (° C.) | Sheet thickness (mm) | Ts (° C.) | Temperature of finish annealing (° C.) | Cooling rate (° C./s) | Crystal grain diameter (mm) | Aging temperature (° C.) | After aging $W_{15/50}$ (W/kg) | After aging $B_{50}$ (T) | After aging TS (MPa) | CTS (MPa) | TS-CTS (MPa) |
|---|---|---|---|---|---|---|---|---|---|---|---|---|
| 26 | — | 0.5 | 674 | 900 | 6 | 0.065 | 450 | 4.85 | 1.76 | 549 | 471 | 78 |
| 27 | 900 | 0.5 | 807 | 900 | 6 | 0.063 | 450 | 3.64 | 1.75 | 749 | 527 | 222 |
| 28 | 1050 | 0.5 | 749 | 900 | 6 | 0.066 | 450 | 2.43 | 1.64 | 872 | 758 | 115 |
| 29 | 950 | 0.5 | 720 | 1000 | 6 | 0.096 | 450 | 3.41 | 1.74 | 546 | 474 | 72 |
| 30 | 1050 | 0.2 | 720 | 1000 | 6 | 0.096 | 500 | 2.06 | 1.69 | 828 | 739 | 89 |
| 31 | 1050 | 0.2 | 762 | 1000 | 6 | 0.113 | 500 | 2.15 | 1.69 | 890 | 730 | 160 |
| 32 | 1050 | 0.2 | 807 | 1000 | 6 | 0.105 | 500 | 2.15 | 1.70 | 885 | 631 | 254 |
| 33 | 1050 | 0.2 | 618 | 1000 | 6 | 0.109 | 500 | 1.97 | 1.71 | 757 | 707 | 50 |
| 34 | 1050 | 0.2 | 762 | 1000 | 6 | 0.137 | 500 | 2.37 | 1.77 | 798 | 638 | 160 |
| 35 | 1050 | 0.2 | 807 | 1000 | 6 | 0.095 | 500 | 3.85 | 1.69 | 911 | 656 | 254 |

INDUSTRIAL APPLICABILITY

According to the present invention, an age-hardenable non-oriented electrical steel sheet can be obtained in which superior punchabilities and a superior iron loss can be simultaneously achieved and in which strengths are significantly increased by aging treatment.

In addition, according to the present invention, an electrical steel sheet having superior magnetic properties and high strengths can be stably provided.

From the steel sheets described above, rotors having high strengths and high reliability can be efficiently and economically manufactured, the rotors being used for high speed motors and magnet-embedded type motors.

The invention claimed is:

1. A non-oriented electrical steel sheet comprising: on a mass percent basis, C: 0.02% or less;

Si: 4.5% or less;

Mn: 3% or less;

Al: 3% or less;

P: 0.5% or less;

Ni: 5% or less; and

Cu: 0.2% to 4%, wherein a volume ratio of Cu precipitates in crystal grain interior is in the range of from 0.2% to 2%, and an average particle size of the Cu precipitates is in the range of from 1 to 20 nm.

2. A non-oriented electrical steel sheet comprising: on a mass percent basis, C: 0.02% or less;

Si: 4.5% or less;

Mn: 3% or less;

Al: 3% or less;

P: 0.5% or less;

Ni: 5% or less; and

Cu: 0.2% to 4%, wherein the yield stress is not less than CYS (MPa) represented by the following formula 1, a volume ratio of Cu precipitates in crystal grain interior is in the range of from 0.2% to 2%, and an average particle size of the Cu precipitates is in the range of from 1 to 20 nm:

$$CYS=180+5{,}600[\%\ C]+95[\%\ Si]+50[\%\ Mn]+37[\%\ Al]+435[\%\ P]+25[\%\ Ni]+22d^{-1/2} \quad \text{(Formula 1)}$$

where d is an average grain diameter (mm) of the crystal grains.

3. A non-oriented electrical steel sheet comprising: on a mass percent basis, C: 0.02% or less;

Si: 4.5% or less;

Mn: 3% or less;

Al: 3% or less;

P: 0.5% or less;

Ni: 5% or less; and

Cu: 0.2%to 4%, wherein the steel sheet forms Cu precipitates in crystal grain interior having a volume ratio of 0.2% to 2% and an average particle size of 1 to 20 nm by aging treatment at 500° C. for 10 hours.

4. The non-oriented electrical steel sheet according to one of claims 1 to 3, further comprising at least one of Zr, V, Sb, Sn, Ge, B, Ca, a rare earth element, and Co as a component, wherein the content of each of Zr and V is 0.1% to 3%, the content of each of Sb, Sn, and Ge is 0.002% to 0.5%, the content of each of B, Ca, and the rare earth element is 0.001% to 0.01%, and the content of Co is 0.2% to 5%.

5. The non-oriented electrical steel sheet according to claim 1, wherein the steel sheet has an iron loss of 6 W/kg or less.

6. The non-oriented electrical steel sheet according to claim 2, wherein the steel sheet has an iron loss of 6 W/kg or less.

7. The non-oriented electrical steel sheet according to claim 3, wherein the steel sheet has an iron loss of 6 W/kg or less.

8. The non-oriented electrical steel sheet according to claim 4, wherein the steel sheet has an iron loss of 6 W/kg or less.

9. The non-oriented electrical steel sheet according to claim 1, wherein the steel sheet has a yield strength of 450 MPa or more.

10. The non-oriented electrical steel sheet according to claim 2, wherein the steel sheet has a yield strength of 450 MPa or more.

11. The non-oriented electrical steel sheet according to claim 3, wherein the steel sheet has a yield strength of 450 MPa or more.

12. The non-oriented electrical steel sheet according to claim 4, wherein the steel sheet has a yield strength of 450 MPa or more.

* * * * *